US007532836B2

(12) United States Patent
Kawabuchi et al.

(10) Patent No.: US 7,532,836 B2
(45) Date of Patent: May 12, 2009

(54) DOCUMENT MANAGEMENT METHOD, DOCUMENT MANAGEMENT SYSTEM, AND COMPUTER PROGRAM PRODUCT

(75) Inventors: Yoichi Kawabuchi, Itami (JP); Yoshiyuki Tamai, Itami (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 253 days.

(21) Appl. No.: 11/545,560

(22) Filed: Oct. 11, 2006

(65) Prior Publication Data

US 2007/0223955 A1 Sep. 27, 2007

(30) Foreign Application Priority Data

Mar. 22, 2006 (JP) ..... 2006-079554

(51) Int. Cl.
*G03G 15/00* (2006.01)

(52) U.S. Cl. ..... 399/80; 399/81

(58) Field of Classification Search ..... 399/79–81
See application file for complete search history.

(56) References Cited

U.S. PATENT DOCUMENTS

| | | | |
|---|---|---|---|
| 6,339,650 | B1 | 1/2002 | Yoshida et al. |
| 6,556,688 | B1 | 4/2003 | Ratnakar |
| 6,738,491 | B1 | 5/2004 | Ikenoue et al. |
| 6,801,935 | B2 | 10/2004 | Shen |
| 6,813,385 | B2 | 11/2004 | Ideyama |
| 2002/0051162 | A1 | 5/2002 | Kawaguchi et al. |
| 2003/0021442 | A1 | 1/2003 | Suzaki |
| 2004/0148507 | A1 | 7/2004 | Iwamura et al. |
| 2005/0206158 | A1 | 9/2005 | Noyama et al. |

FOREIGN PATENT DOCUMENTS

| | | | |
|---|---|---|---|
| JP | 10-276335 | A | 10/1998 |
| JP | 2004-040819 | A | 2/2004 |
| JP | 2004-228897 | A | 8/2004 |
| JP | 2004-320080 | A | 11/2004 |
| JP | 2005-176182 | A | 6/2005 |
| JP | 2005-354141 | A | 12/2005 |

OTHER PUBLICATIONS

Japanese Office Action (with English language translation) dated Aug. 21, 2007.

*Primary Examiner*—Hoang Ngo
(74) *Attorney, Agent, or Firm*—Buchanan Ingersoll & Rooney PC

(57) ABSTRACT

The image of a document is depicted on a sheet of paper together with a background pattern image expressing a password, and the password is notified to a person having authority to duplicate the document. A requestor requesting duplication of the document is caused to enter a password (#104), and the document image and the background pattern image are obtained by scanning the sheet (#101). Then, it is determined whether the requestor has the above-described authority, based on the entered password and the password expressed by the obtained background pattern image (#105). When it is determined that the requestor has the authority, a different password is issued. The document image is printed on a separate sheet of paper together with a background pattern image expressing the different password, and the different password is notified to a person having authority to duplicate the document printed on the separate sheet of paper.

15 Claims, 19 Drawing Sheets

FIG. 7

DB1

| FILE NAME | DOCUMENT NUMBER | PASSWORD | USER NAME | |
|---|---|---|---|---|
| 00001.pdf | 00001 | 4%27845yi5 | KAWABUCHI | ~DCJ |
| 00002.pdf | 00002 | 6&68$78#19 | TAMAI | ~DCJ |
| 00003.pdf | 00003 | U8sd9#0Q2 | SUZUKI | ~DCJ |
| ⋮ | ⋮ | ⋮ | ⋮ | |

FIG. 11

PLEASE ENTER A DOCUMENT PASSWORD.

DOCUMENT NO. : 00001

PASSWORD : *******

OK CANCEL

HG3

FIG. 15

PLEASE ENTER A PASSWORD.
PLEASE SPECIFY A TRANSMISSION DESTINATION.

DOCUMENT NO. : 00001

PASSWORD : * * * * * * *

TRANSMISSION DESTINATION : 192.168.1.32

OK CANCEL

HG4

DOCUMENT MANAGEMENT METHOD, DOCUMENT MANAGEMENT SYSTEM, AND COMPUTER PROGRAM PRODUCT

This application is based on Japanese Patent Application No. 2006-079554 filed on Mar. 22, 2006, the contents of which are hereby incorporated by reference.

BACKGROUND OF THE INVENTION

1. Field of the Invention

The present invention relates to a method and an apparatus or the like for managing documents while giving consideration to security.

2. Description of the Related Art

Recently, image forming apparatuses called, for example, MFPs (Multi Function Peripherals), which have various functions such as a copier function, a scanner function, a fax function and an Ethernet (registered trademark) communications function, have come into widespread use in offices such as companies or government and municipal offices, academic institutions such as schools or research laboratories, stores such as convenience stores, and various other places, and anyone can now easily use the apparatuses. Furthermore, small and inexpensive image forming apparatuses have been marketed lately, and have begun to gain widespread use in households as well.

Due to the widespread use of the image forming apparatuses, users can easily perform operations for, for example, converting a document image made up of text, diagrams, photographs, illustrations or the like depicted on a sheet of paper into electronic data and storing the data on a hard disk in the image forming apparatuses or a server, or copying it on a separate sheet of paper.

As described above, converting documents into electronic data or copying them on a separate sheet of paper can be readily carried out nowadays, so that documents that should be kept classified are more easily leaked to an indefinite number of outsiders. As a result, management of classified information has become important.

Therefore, for example, methods or apparatuses as described in Japanese unexamined patent publication Nos. 2004-320080, 2004-40819, 10-276335 and 2004-228897 have been proposed as methods for protecting document security.

According to the method described in the first publication, a microminiature memory chip is embedded in a sheet of paper. Then, information of an image that is to be recorded on the sheet is stored on the memory chip together with a password. Further, a background pattern for copy prevention is printed on the sheet. In the case of making a legitimate copy from this sheet, an operator is caused to enter a password by a dedicated copier. When the entered password matches the password stored on the memory chip, the image information stored on the memory chip is read for copying.

According to the method described in the second publication, a script to be subjected to encryption processing or a script to be encrypted, recorded and decrypted is read by an image reading portion, and then stored in an image storing portion via an A/D converter. An encryption mode or a decryption mode is selected based on a processing mode and a PIN number that is entered through a PIN number entry portion, and a number analyzing portion analyzes the entered processing mode and PIN number. An address calculation portion calculates a pixel relocation destination address for performing encryption or decryption processing in accordance with the processing mode by such a method in which a solution to a polynomial equation is derived based on the PIN number. Based on this relocation destination address, a pixel rearrangement/reconfiguration portion replaces the image data stored in the image storing portion.

The image forming apparatus described in the third publication includes an image reading portion that converts a script into image data, an image recognition portion that determines whether the script is an encrypted script by analyzing the image data, an encryption portion that encrypts the image data, a decrypting portion that decrypts the image data, an image input/output control portion that control the entire apparatus, an instruction portion that gives various instructions such as a password to the apparatus, and a printer portion that records the image data on recording paper. The image forming apparatus outputs an encrypted script based on a password specified by the original script, and outputs the same image as that of the original script from the encrypted script based on the password.

According to the method described in the fourth publication, data of an electronic text and data of a background pattern image are first loaded into a RAM from an external storage apparatus. Then, entry of permission conditions as digital watermark information is received through a keyboard or a mouse. Next, the entered permission conditions are embedded in the form of digital watermark information in the text data. Then, the text data in which the digital watermark is embedded is combined with the background pattern image loaded into the RAM, thus generating a text image. Then, the generated text image is converted into print data, and the converted print data is output to a printing apparatus.

For example, in the case of circulating a classified document (e.g., a request for managerial decision) among a group of members, each member checks the document passed from the preceding member, and sends it to the next member. When it is necessary to keep the document in his or her possession, each member duplicates the document, and passes the original document or its duplicate (a sheet of paper or electronic data) to the next member. Each member may perform editing such as writing any necessary information in that document or correcting any errors before passing the document to the next member.

When editing of the document is successively performed in this way, it is necessary to correctly keep track of the order of editing, in particular, the sheet or the electronic data in which the latest version of the document is depicted or recorded. That is, it is necessary to carry out document generation management.

Therefore, if a document is duplicated more times than necessary, then some of the duplicates may not be passed in a predetermined order to reach an unexpected member. In such a case, editing of the document may not be carried out successfully. As such, duplicating a document more times than necessary makes document management complicated. Moreover, it poses a security problem, since the document is easily leaked to many and unspecified persons, as described above.

According to the inventions described in the above-mentioned unexamined patent publication documents, it is possible to protect document security to a certain extent. However, it is not possible to carry out document generation management.

SUMMARY OF THE INVENTION

In view of the foregoing problems, it is an object of the present invention to facilitate document generation management while protecting document security at the same time.

According to one aspect of the present invention, a document management system includes preliminarily depicting an image of a document on a sheet of paper together with a key image expressing a first key in a form that is difficult to recognize by a human, preliminarily notifying a second key corresponding to the first key to a person having authority to duplicate the document, letting a requestor requesting duplication of the document enter the second key, obtaining the document image and the key image by scanning the sheet, determining whether the requestor has said authority, based on the second key entered by the requestor and the first key expressed by the obtained key image, changing the content of the first key and the content of the second key when it was possible to determine that the requestor has said authority, performing duplication processing for duplicating the document image onto a recording medium together with the key image expressing the changed first key, and notifying the changed second key to a person having authority to duplicate the document duplicated onto the recording medium.

Preferably, the duplication processing is performed by printing the key image and the document image on a different sheet of paper. Alternatively, the duplication processing is performed by transmitting, to a transmission destination specified by the requester, electronic data for reproducing the key image and the document image.

According to another aspect of the present invention, a document management system includes preliminarily depicting an image of a document on a sheet of paper together with a key image expressing a first key in a form that is difficult to recognize by a human, preliminarily notifying a second key corresponding to the first key to a person having authority to duplicate the document, preliminarily encrypting electronic data for reproducing the document image using a third key corresponding to the second key to save the electronic data, letting a requestor requesting duplication of the document enter the second key, obtaining the key image by scanning the sheet, determining whether the requestor has said authority, based on the second key entered by the requestor and the first key expressed by the obtained key image, performing processing for decrypting the electronic data using the second key entered by the requester, changing the content of the first key, the content of the second key and the content of the third key when it was possible to determine that the requestor has said authority and to decrypt the electronic data, performing duplication processing for duplicating the document image onto a recording medium together with the key image expressing the changed first key, re-encrypting the decrypted electronic data using the changed third key, and notifying the changed second key to a person having authority to duplicate the document duplicated onto the recording medium.

According to yet another aspect of the present invention, a document management system includes preliminarily depicting an image of a document on a sheet of paper together with a key image expressing a first key in a form that is difficult to recognize by a human, preliminarily notifying a second key corresponding to the first key to a person having authority to duplicate the document, letting a requestor requesting duplication of the document enter the second key, obtaining the document image and the key image by scanning the sheet, determining whether the requestor has said authority, based on the second key entered by the requestor and the first key expressed by the obtained key image, encrypting image data of the document image using the second key as an encryption key when it was possible to determine that the requestor has said authority, and transmitting the encrypted image data to a destination specified by the requestor.

According to the present invention, it is possible to readily carry out document security management. With the invention according to claims 1 to 10, and 12 to 15, it is also possible to readily perform document generation management.

BRIEF DESCRIPTION OF THE DRAWINGS

FIG. 7 is a diagram showing an example of a document information database.

FIG. 11 is a diagram showing an example of a document password entry screen.

FIG. 15 is a diagram showing an example of a document password entry screen.

DESCRIPTION OF THE PREFERRED EMBODIMENTS

Figure 1:
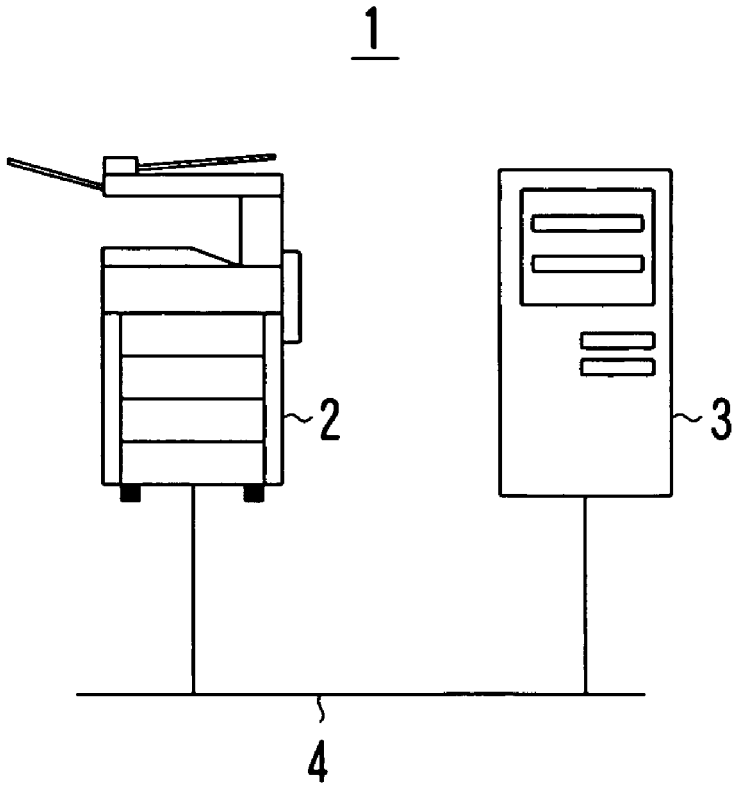
FIG. 1 is a diagram showing an example of the overall configuration of a document management system.
Figure 2:
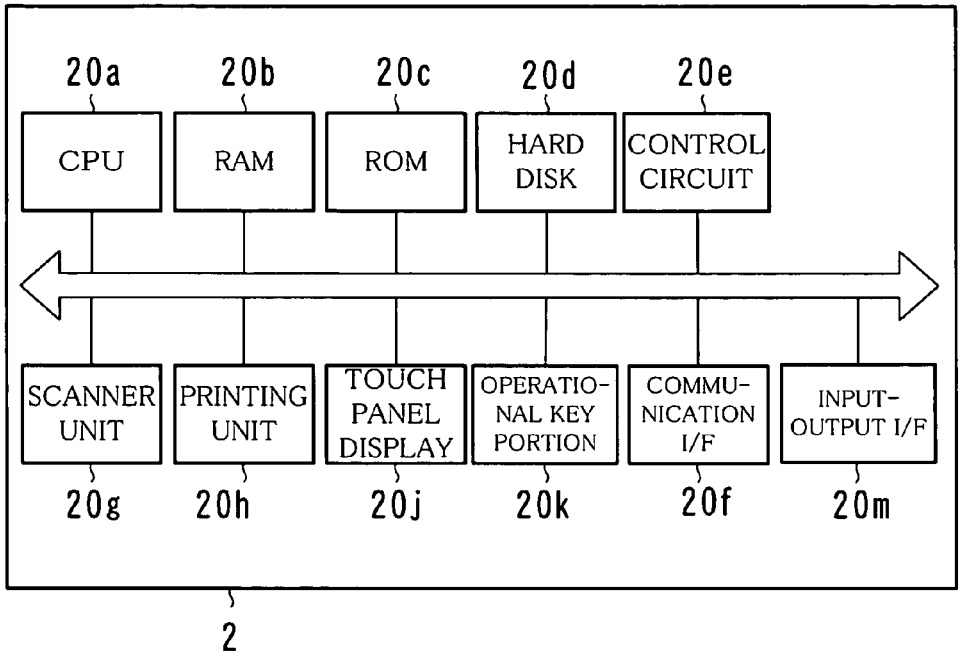
FIG. 2 is a diagram showing an example of the hardware configuration of an image forming apparatus.
Figure 3:
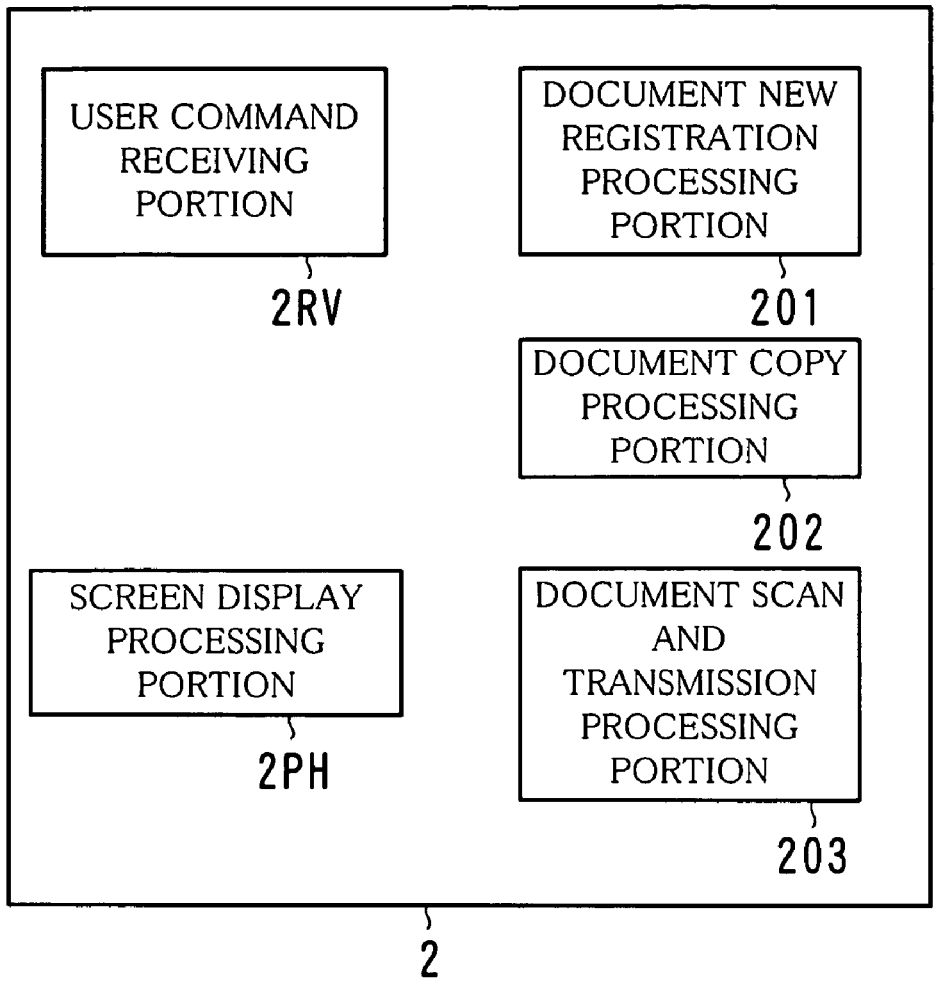
FIG. 3 is a diagram showing an example of the functional configuration of the image forming apparatus.

Referring to FIGS. 1, 2 and 3, an example of the overall configuration of a document management system 1, an example of the hardware configuration of an image forming apparatus 2, and an example of the functional configuration of the image forming apparatus 2 will be described.

As shown in FIG. 1, the document management system 1 includes the image forming apparatus 2, a document server 3 and a communication line 4, for example. The image forming apparatus 2 and the document server 3 are connected to each other via the communication line 4. As the communication line 4, a LAN, the Internet, a public line or a private line can be used, for example.

The image forming apparatus 2 is a processing apparatus in which various processing functions such as copying, SCAN-TO-PC, facsimile and network printing are integrated. In general, the image forming apparatus 2 may also be called an MFP (Multi Function Peripheral).

"SCAN-TO-PC" is a function of converting an image read by scanning the printed surface of a sheet of paper into image data, and transmitting the image data to a terminal that is specified by a user, such as a personal computer (PC).

"Network printing" is a function of receiving image data from a terminal such as a personal computer via a communication line such as a LAN, and printing the image on a sheet of paper. This may also be called a "network printer function" or a "PC print function", for example.

As shown in FIG. 2, the image forming apparatus 2 includes a CPU 20*a*, a RAM 20*b*, a ROM 20*c*, a hard disk 20*d*, a control circuit 20*e*, a communication interface 20*f*, a scanner unit 20*g*, a printing unit 20*h*, a touch panel display 20*j*, an operation key portion 20*k* and an input-output interface 20*m*, for example.

The control circuit 20*e* is a circuit for controlling, for example, the hard disk 20*d*, the communication interface 20*f*, the scanner unit 20*g*, the printing unit 20*h*, the touch panel display 20*j*, the operation key portion 20*k*, and the input-output interface 20*m*.

The communication interface 20*f* may be, for example, a modem for carrying out data communication with an external fax terminal, or an NIC (Network Interface Card) for carrying out data communication with the document server 3.

The operation key portion 20*k* is made up of, for example, a numeric key pad and a cursor key, and is used by a user to provide commands, such as a command to start execution of processing, to the image forming apparatus 2 and to specify processing conditions and various other matters. The touch panel display 20*j* displays a screen for providing messages or instructions to the user, a screen for the user to enter desired types of processing and processing conditions, and a screen indicating results of the processing executed in the CPU 20*a*, for example. In addition, the user can provide commands to the image forming apparatus 2 or specify processing conditions by touching predetermined positions on the touch panel display. Thus, the printing unit 20*h* and the operation key portion 20*k* serve as the user interfaces for the user operating the image forming apparatus 2.

The scanner unit 20*g* optically reads a document image expressed by text, numerical expressions, symbols, photographs, diagrams or illustrations that are depicted on a sheet of paper, and generates image data.

The printing unit 20*h* forms a document image based on the document image data obtained with the scanner unit 20*g* or the image data transmitted from a personal computer or the like, and prints the image on a sheet of paper by electrophotography or an inkjet method, for example.

The input-output interface 20*m* is an interface such as USB or IEEE1394, and can be connected to a device such as a flash memory reader/writer, an MO disk drive or a CD-RW drive.

As shown in FIG. 3, a program and data for implementing the function of a document new registration processing portion 201, a document copy processing portion 202, a document scan and transmission processing portion 203, a user command receiving portion 2RV, a screen display processing portion 2PH and the like are installed on the hard disk 20*d*. The above-described program and data are read into the RAM 20*b* as needed, and the program is executed by the CPU 20*a*. Alternatively, some or all of the functions shown in FIG. 3 may be implemented with the control circuit 20*e*.

Figure 4:
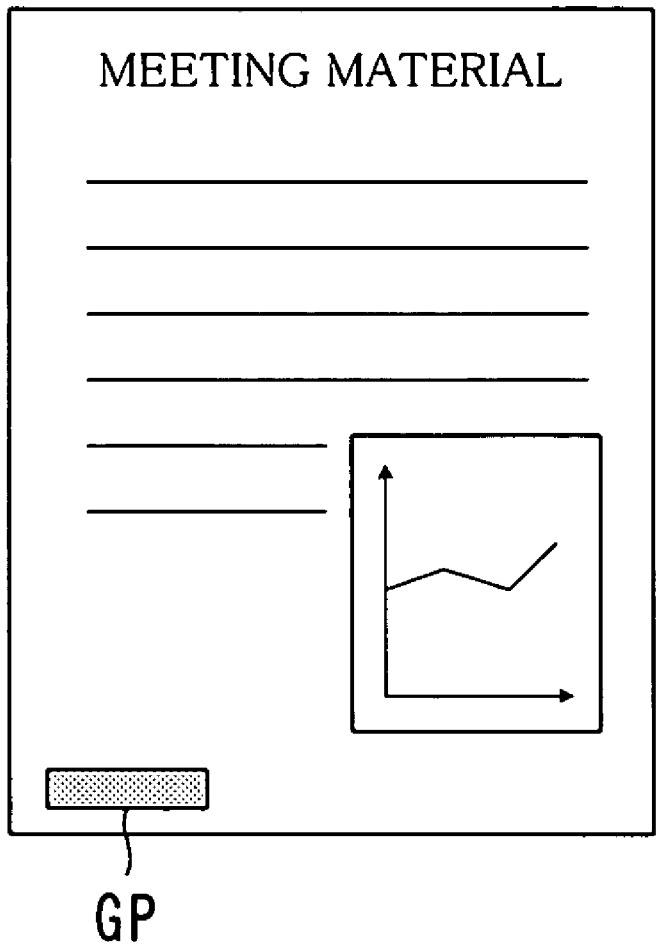
FIG. 4 is a diagram showing an example of the positional relationship between a document image and a background pattern image.

FIG. 4 is a diagram showing an example of a document having a document image with a background pattern image GP added thereto.

In the following, documents (paper documents) that are handled by this document management system 1 are described. In general, a document is produced by a person, for example, by writing text, numerical expressions, symbols, diagrams, illustrations or the like with a pen, or pasting clippings, on a sheet of paper.

A document can also be produced with applications such as word-processing software, spreadsheet software or drawing software on a personal computer. In this case, the document is electronically recorded in a recording medium such as a RAM, a hard disk or a removable disk. The produced document is printed on a sheet of paper by the network printing function of the image forming apparatus 2 or a printing apparatus connected to the personal computer.

In this way, upon its production, a document may be recorded on a sheet of paper with ink or the like, or may be electronically recorded in a RAM or the like. The user prepares a document that is to be managed by the document management system 1 by any one of the above-described methods.

Alternatively, the user may prepare an existing printed matter as a document that is to be managed by the document management system 1.

Hereinafter, a document upon its preparation may be particularly referred to as an "original document". However, in this embodiment, a document that has been produced by an application in order to add a background pattern image GP, which will be described later, to the document is printed in advance on a sheet of paper by a printing apparatus such as the image forming apparatus 2. That is, regardless of the method of preparation, a document depicted on a sheet of paper prepared immediately before the start of management by the document management system 1 is an "original document" according to this embodiment.

The user can use the copy function of the image forming apparatus 2 to copy the original document on a separate sheet of paper.

Alternatively, the user can use the SCAN-TO-PC function of the image forming apparatus 2 to convert the original document into electronic data and to transmit the data to a personal computer. A person who has received the electronic data can print the document on a sheet of paper using a printing apparatus connected to the personal computer. The document of the electronic data transmitted to the personal computer by the SCAN-TO-PC function can be called a duplicate of the original document.

Thus, the user can duplicate the original document by the copy function or the SCAN-TO-PC function of the image forming apparatus 2. Hereinafter, a duplicate of the original document is referred to as a "duplicate document".

A duplicate document can be further duplicated in a similar manner. Hereinafter, in order to differentiate documents that are successively duplicated in this way, a duplicate of the original document may be referred to as a "second generation document", and a duplicate of an n-th generation document may be referred to as an "n+1-th generation document". For example, a duplicate of a second generation document may be referred to as a "third generation document", and a duplicate of a third generation document may be referred to as a "fourth generation document". It should be understood that the original document is a first generation document.

However, the management rule that "there should exist only a single copy of a document per generation" is set for the document management system 1. That is, the user should prepare only a single copy of the original document. In addition, copying or SCAN-TO-PC can be performed only once per generation for each document. For example, once the image forming apparatus 2 has performed copying for a document of a second generation (i.e., once the next generation document has been produced), the image forming apparatus 2 is not permitted to perform either copying or SCAN-TO-PC for that second generation document in the future.

Furthermore, only a user who knows the password can let the image forming apparatus 2 perform copying or SCAN-TO-PC.

The background pattern image GP is used for carrying out document management in accordance with such a rule. More specifically, the background pattern image GP expressing the document number used for discriminating that document from other documents and the password used for the generation management is printed or pasted on a predetermined position (e.g., on the margin, where no document content is placed) on the document, as shown in FIG. 4.

This background pattern image GP is seen only as a background pattern (dot pattern) by human eyes. However, the placement of the dots (points) represents the document number and the password. In other words, the document number and the password are embedded in the background pattern image GP. As a technique for creating the background pattern image GP and printing it on a sheet of paper and a technique for reading and analyzing the background pattern image GP, known digital watermarking techniques can be used. There are many documents relating to the "digital watermarking technique". For example, the following publications will help to understand the term.

Japanese unexamined patent publication No. 2005-176182

U.S. patent application publication No. 2003/0021442

U.S. patent application publication No. 2005/0206158

The method for using the background pattern image GP will be described later.

Figure 5:
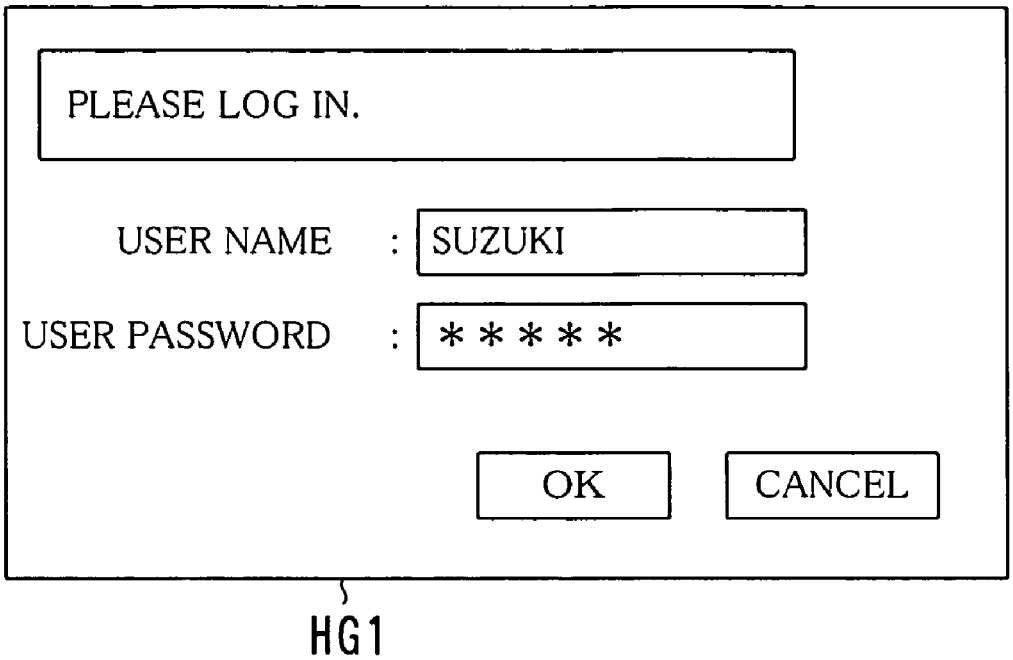
FIG. 5 is a diagram showing an example of a log-in screen.
Figure 6:
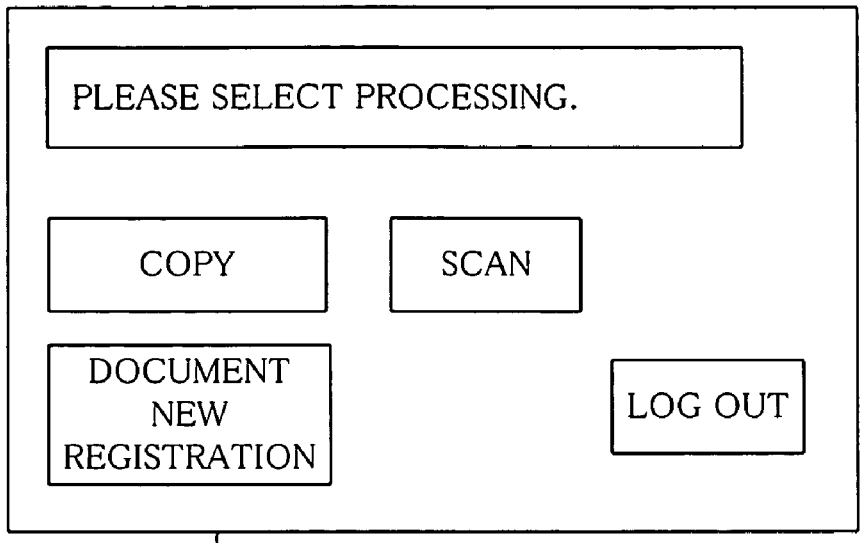
FIG. 6 is a diagram showing an example of a processing command screen.

Referring to FIGS. 5 and 6, a log-in procedure and a processing commanding procedure will be described. In FIG. 7, a document information database DB1 for managing documents is shown.

Next, the details of the processing of various portions of the image forming apparatus 2 shown in FIG. 3 and the document server 3 are specifically described.

In FIG. 3, the screen display processing portion 2PH of the image forming apparatus 2 performs processing for generating a screen (so-called standby screen) for waiting for the user to provide a processing command or to designate processing conditions and displaying it on the touch panel display 20*j*.

The user command receiving portion 2RV performs processing for receiving a user command or designation.

For example, when no one is using the image forming apparatus 2, the screen display processing portion 2PH displays a log-in screen HG1 as shown in FIG. 5 on the touch panel display 20*j*. With the log-in screen HG1 being displayed, a user who is about to use the image forming apparatus 2 enters his or her own user account name (user name) and password (user password), and touches an "OK" button.

Then, the user command receiving portion 2RV receives the entered user name and user password, as well as a log-in command, and requests a user authentication portion (not shown) to perform user authentication processing. The user authentication portion in the image forming apparatus 2 performs user authentication processing based on the entered user name and user password in a conventional manner. When it was possible to determine that the user (entered person) is an authorized user, the user authentication portion allows the user to log in to the image forming apparatus 2. Thus, the user is permitted to use the image forming apparatus 2. It should be noted that "user password" is different from the password embedded in the background pattern image GP.

Further, after the user has logged in, the screen display processing portion 2PH displays a processing command screen HG2 as shown FIG. 6 on the touch panel display 20*j*. Here, by touching the displayed button corresponding to a desired process, the user can provide a processing command to the image forming apparatus 2 to which the user has logged in. The details of each processing will be described in order. Other screens that are displayed on the touch panel display 20*j* by the screen display processing portion 2PH will also be described in order.

The document server 3 centrally handles data relating to documents under management. Specifically, a directory DY for saving the document files DCF of the documents under management is provided in the hard disk of the document server 3. Additionally, a document information database DB1 is provided. As shown in FIG. 7, document information DCJ for each of the document files DCF saved in the directory DY is stored in this document information database DB1. The document information DCJ indicates, for example, the file name of the document file DCF, the document number of the document, the password used as the encryption key for encryption, and the user name of the user, who is the owner of the document.

In order to let the document management system 1 manage a document, the user needs to register in advance the document file DCF and document information DCJ of the document in the directory DY and document information database DB1, respectively, of the document server 3. The document file DCF and the document information DCJ are prepared by the document new registration processing portion 201, which will be described next, of the image forming apparatus 2.

[Registration Processing of New Document]

Figure 8:
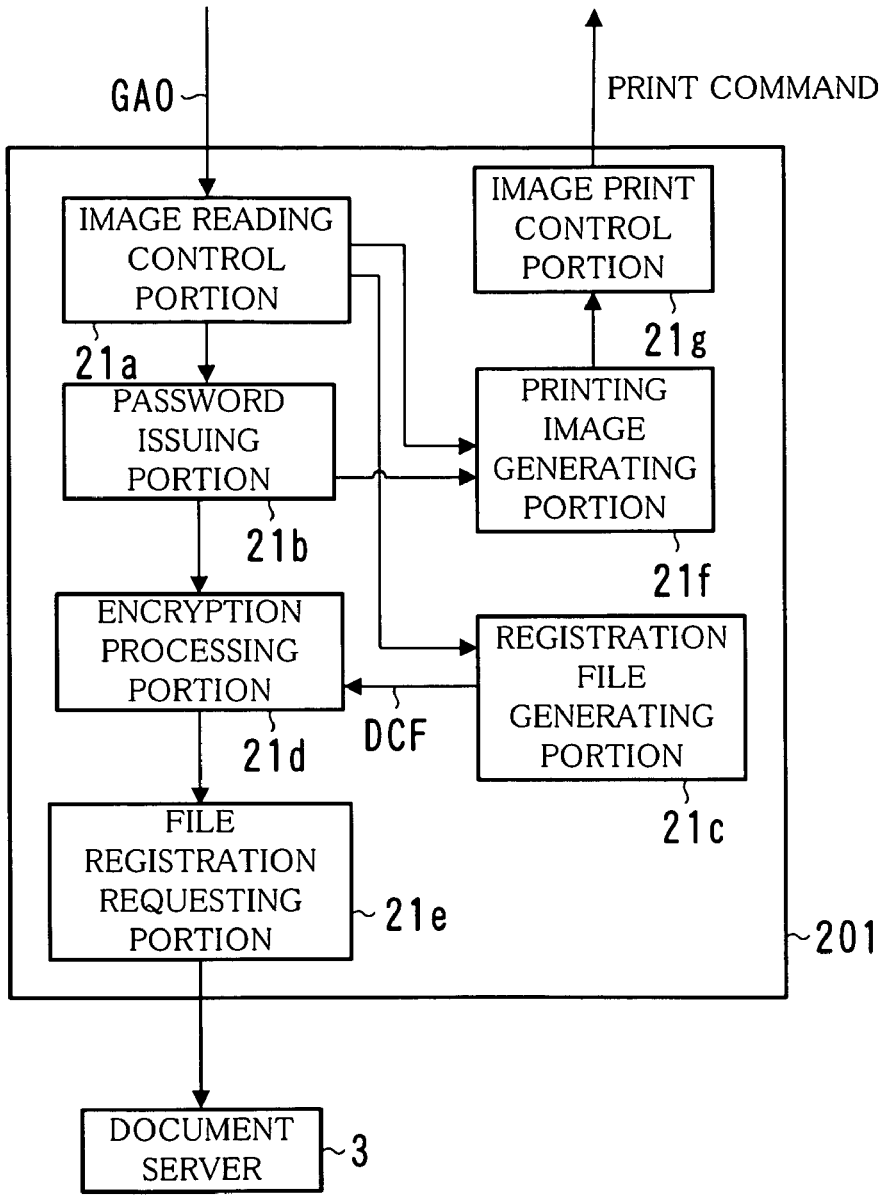
FIG. 8 is a diagram showing an example of the configuration of a document new registration processing portion.

Referring to FIG. 8, the document new registration processing will be described.

As shown in FIG. 8, the document new registration processing portion 201 includes, for example, an image reading control portion 21*a*, a password issuing portion 21*b*, a registration file generating portion 21*c*, an encryption processing portion 21*d*, a file registration requesting portion 21*e*, a printing image generating portion 21*f*, and an image print control portion 21*g*, and carries out processing for registering the document file DCF and the document information DCJ of a document that is to be newly managed in the document server 3 and processing for adding the background pattern image GP to that document.

The image reading control portion 21*a* controls the scanner unit 20*g* so as to read the image of a document that the user desires to manage from now on (i.e., an original document). Such control may be carried out, for example, as follows. After logging in to the image forming apparatus 2, the user places the sheet of an original document that the user desires to manage from now on on a platen of the image forming apparatus 2, and touches a "document new registration" button on the processing command screen HG2 (see FIG. 6).

Then, the image reading control portion 21*a* provides a command to the scanner unit 20*g* to scan the sheet that has been placed. The scanner unit 20*g* scans the script surface of the sheet, and obtains the image data of the original document image depicted on the sheet. Hereinafter, the read image is referred to as a "read image GA0".

The password issuing portion 21*b* issues a password and a document number for the original document. The password is used for encrypting the document file DCF of this original document that is used for registering (saving) in the document server 3. The document number is discrimination information for discriminating that document from other documents that have been already registered in the document server 3. Accordingly, the password issuing portion 21*b* accesses the document server 3 to select a number that does not coincide with the document numbers of other documents, and provides this number as the document number.

The registration file generating portion 21*c* generates a document file DCF by converting the image data of the read image GA0 into image data in a predetermined format (e.g., PDF by Adobe Systems Incorporated) and converting it into a file. This document file DCF is provided with a file name not coinciding with the file names of other document files DCF that have already been saved in the directory DY of the document server 3. For example, a file name made by combining the document number and an extension, such as "00001.pdf", may be provided.

The encryption processing portion 21*d* encrypts the generated document file DCF using, as an encryption key, the password issued by the password issuing portion 21*b*. In this embodiment, common key cryptography is used.

The file registration requesting portion 21*e* transmits, to the document server 3, the encrypted document file DCF together with the document information DCJ indicating, for example, the file name, the document number and the password of that document file DCF, as well as the user name of the user who has performed the current operation (i.e., the user logging in to the image forming apparatus 2), and requests the document server 3 to newly register the document file DCF and the document information DCJ.

Then, the document server 3 newly saves or stores the received document file DCF and document information DCJ in the directory DY and the document information database DB1, respectively. Consequently, registration of the document is completed, and management of the document is started.

In addition, after the document (here, the original document) is read by the image reading control portion 21*a*, the user places the sheet of the document onto a manual feed tray of the image forming apparatus 2.

The printing image generating portion 21*f* generates a background pattern image GP in which the document number and the password that have been issued by the password issuing portion 21*b* are embedded. The method of generating the background pattern image GP is well known, and therefore its description has been omitted. Further, the background pattern image GP is expanded into a bitmapped image by an RIP (Raster Image Processor).

Then, the image print control portion 21*g* controls the printing unit 20*h* so as to print the bitmapped background pattern image GP at a predetermined location on the sheet placed on the manual feed tray.

Alternatively, the background pattern image GP may be printed on a blank sheet of paper or label, and the user may, for example, cut out the background pattern image GP portion and paste it on the sheet of the original document.

Thus, the data relating to the document under management is registered in the document server 3, and the background pattern image GP is added to the sheet of the original document, as shown in FIG. 4. Consequently, preparation for the document management is completed.

After completion of the preparation, the screen display processing portion 2PH in FIG. 3 notifies the currently issued document number and password to the user by displaying them on the touch panel display 20*j*. The user needs to remember the password in association with the currently registered document. It is preferable that the user remember the password and the document number as a pair. Alternatively, when there is a person who has the authority to duplicate the original document, the user needs to notify the password and the document number to that person.

[Copying of Document]

Figure 9:
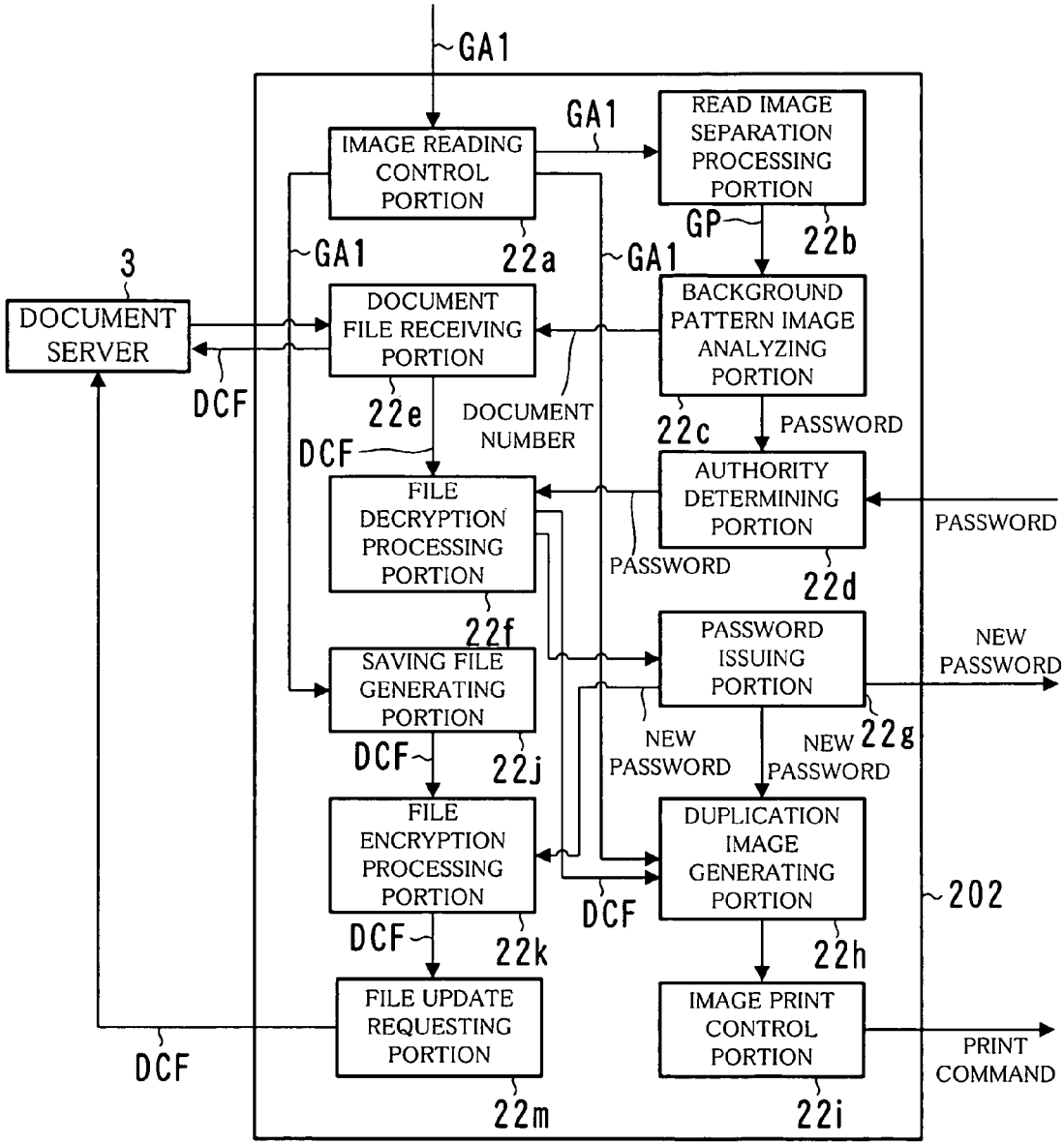
FIG. 9 is a diagram showing an example of the configuration of a document copy processing portion.
Figure 10:
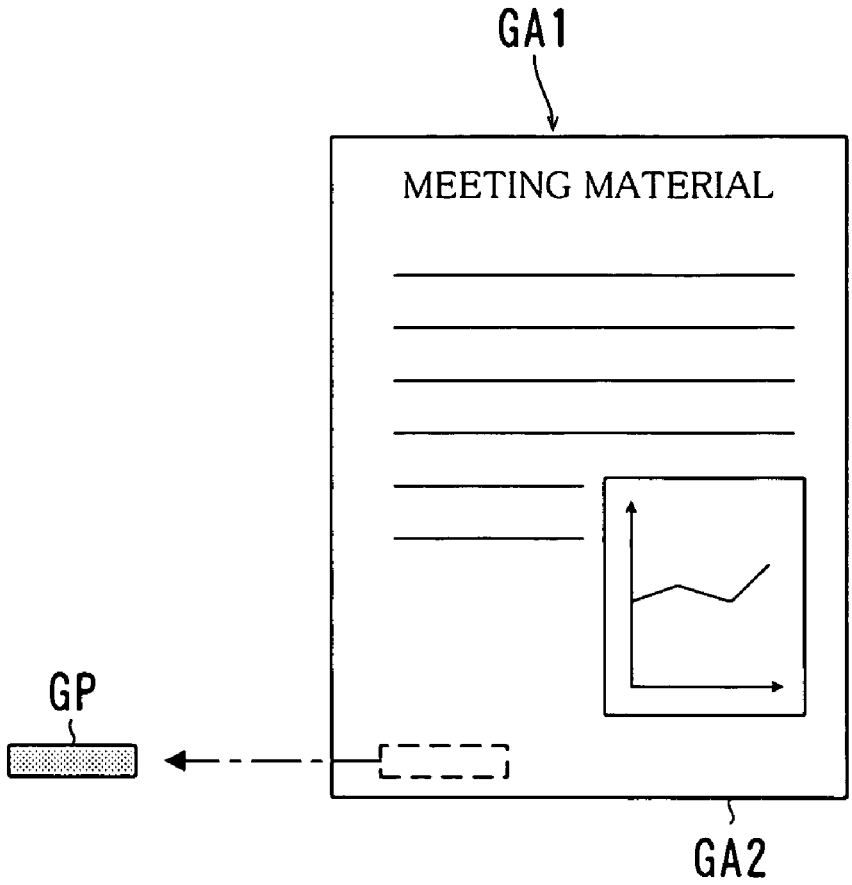
FIG. 10 is a diagram illustrating an example of the method of separating the document image and the background pattern image.

Referring to FIGS. 9, 10 and 11, an example of the configuration of the document copy processing portion 202, an example of the method of separating a document image GA2 and the background pattern image GP, and an example of a document password entry screen HG3 will be described.

As shown in FIG. 9, the document copy processing portion 202 includes, for example, an image reading control portion 22*a*, a read image separation processing portion 22*b*, a background pattern image analyzing portion 22*c*, an authority determining portion 22*d*, a document file receiving portion 22*e*, a file decryption processing portion 22*f*, a password issuing portion 22*g*, a duplication image generating portion 22*h*, an image print control portion 22*i*, a saving file generating portion 22*j*, a file encryption processing portion 22*k* and a file update requesting portion 22*m*.

With such a configuration, the document copy processing portion 202 performs processing for duplicating a document on a sheet of paper using the copy function of the image forming apparatus 2. At this time, management is carried out in accordance with the above-described rule such that only a user who has the authority is permitted to perform this processing and that not more than one copy per generation will be made for that document.

The image reading control portion 22*a* controls the scanner unit 20*g* so as to read the image of a document that is to be subjected to copying. Such control is carried out, for example, as follows. After logging in to the image forming apparatus 2, the user places the sheet of the document that he or she desires to copy on the platen of the image forming apparatus 2, and touches a "copy" button on the processing command screen HG2 (see FIG. 6).

Then, the image reading control portion 22*a* provides a command to the scanner unit 20*g* to scan the sheet that has been placed. The scanner unit 20*g* scans the script surface of the sheet, and obtains the image data of the document image depicted on the sheet. Hereinafter, the read image is referred to as a "read image GA1". When the processing for registering the data relating to that document in the document server 3 has already been completed, the read image GA1 includes the background pattern image GP (see FIG. 4). In the following, a description is given for a case where registration of the document has been completed.

As shown in FIG. 10, the read image separation processing portion 22*b* separates the read image GA1 into a document image GA2, which is the image of the document portion, and a background pattern image GP. For example, it separates the read image GA1 into a document image GA2 and a background pattern image GP by cutting out the background pattern image GP placed at a predetermined position from the read image GA1.

The background pattern image analyzing portion 22*c* analyzes the background pattern image GP, thereby extracting the document number and the password that are expressed by the background pattern image GP. The method of the analysis is well known, and therefore its description has been omitted.

After the document number is extracted by the background pattern image analyzing portion 22*c*, the screen display processing portion 2PH shown in FIG. 3 displays on the touch panel display 20*j* the document password entry screen HG3 as shown in FIG. 11 that prompts the user to enter the password corresponding to the document with the document number. At this time, the user enters the previously notified password of the document.

The authority determining portion 22*d* determines whether the user who has provided the command has a legitimate authority, based on the entered password and the password embedded in the background pattern image GP. In this embodiment, it is determined that the user has a legitimate authority when the two passwords match. When such determination is made, the processing described below is started by the document file receiving portion 22*e* and the file decryption processing portion 22*f*. When such determination is not made, the screen display processing portion 2PH displays on the touch panel display 20*j* a message indicating that the document cannot be copied, and stops the copy processing.

The document file receiving portion 22*e* receives (downloads), from the document server 3, the document file DCF with the document number obtained by the background pattern image analyzing portion 22*c*, for example, as follows. The document file receiving portion 22*e* accesses the document server 3 to present the document number to the document server 3, and requests the document file DCF.

Then, the document server 3 retrieves the document information DCJ indicating the document number from the document information database DB1 (see FIG. 7). It then retrieves the document file DCF with the file name indicated in the located document information DCJ from the directory DY. Then, it sends the located document file DCF to the image forming apparatus 2, which is the source of request. Consequently, the document file DCF is downloaded to the image forming apparatus 2.

The file decryption processing portion 22*f* decrypts the received document file DCF using the password entered by the user as a common key (decryption key). If the password entered by the user is that of the latest generation of the document, then the document file DCF can be decrypted normally. However, if the password is that of one or more generations older, then the password does not match the encryption key (password) used for encrypting the document file DCF, so that the document file DCF cannot be decrypted. The reason is that, as will be described later, the document file DCF is re-encrypted with a different password each time the generation advances by one.

When it was possible to perform decryption, processing is started by the password issuing portion 22*g*, the duplication image generating portion 22*h*, the image print control portion 22*i*, the saving file generating portion 22*j*, the file encryption processing portion 22*k* and the file update requesting portion 22*m*. When it was not possible to perform decryption, a message indicating that the document cannot be copied is displayed on the touch panel display 20*j*, and the copy processing is stopped.

The password issuing portion 22*g* reissues a password with a character string different from that of the password that has been previously issued for that document.

The duplication image generating portion 22*h* generates a duplication image GA3 that is to be duplicated (copied) on a sheet of paper as follows. The duplication image generating portion 22*h* generates a background pattern image GP in which the document number of a document that is to be subjected to copying (i.e., the document number obtained by the background pattern image analyzing portion 22*c*) and the new password issued by the password issuing portion 22*g* are embedded. Then, it arranges the document image and the generated background pattern image GP in their respective predetermined positions, and combines them into a single image, as with the source document, i.e., as shown in FIG. 4. Consequently, a duplication image GA3 is completed. Furthermore, the duplication image GA3 is expanded into a bitmapped image by an RIP.

As the document image for combination, the document image GA2 obtained by the read image separation processing portion 22*b*, i.e., the image read from the sheet may be used, or the image reproduced from the document file DCF that has been downloaded from the document server 3 and then decrypted may also be used. Which of the images is used may be determined by the user according to the purpose or the like, or may be automatically determined by the image forming apparatus 2. For example, the user may edit the document, for example, by adding information to the sheet or correcting errors thereof before starting the operation for the current copying. When the user desires to manage the edited document in the future, the user may use the document image GA2. When the user has not edited the document, or desires to continue the management of the document after returning the document into its state before editing, the user may use the image reproduced from the document file DCF that has been downloaded and then decrypted.

The image print control portion 22*i* controls the printing unit 20*h* so as to print (copy), on a blank sheet of paper, the duplication image GA3 that has been generated and expanded into a bitmapped image by the duplication image generating portion 22*h*. Consequently, a duplicate of the document is obtained. This duplicate is the next generation of the document. For example, when the document that has been subjected to the current copying is the original document, a second generation document is obtained. When the document that has been subjected to the current copying is an m-th generation document, an m+1-th generation document is obtained.

On the other hand, in order to prevent the document of the generation that has been subjected to the current copying from being duplicated again (i.e., in order that only a single copy exists for the latest generation of the document) after completion of the copy processing by the image print control portion 22*i*, the saving file generating portion 22*j*, the file encryption processing portion 22*k* and the file update requesting portion 22*m* perform the following processes.

The saving file generating portion 22*j* re-generates the document file DCF of the document as needed. For example, when the user desires to manage the edited document in the future as in the case of selecting the image in the duplication image generating portion 22*h*, the saving file generating portion 22*j* re-generates the document file DCF by converting the document image GA2 obtained by the read image separation processing portion 22*b* into a file. When the user has not edited the document, or desires to continue the management of the document after returning the document into its state before editing, the regeneration of the document file DCF is not carried out, and the document file DCF that has been downloaded from the document server 3 and then decrypted is used for future processing.

The file encryption processing portion 22*k* encrypts the document file DCF that has been re-generated as needed, using the password reissued by the password issuing portion 22*g* as an encryption key.

The file update requesting portion 22*m* transmits, to the document server 3, the encrypted document file DCF together with the document information DCJ indicating, for example, the file name, the document number and the reissued password of that document file DCF, as well as the user name of the user who has performed the current operation (i.e., the user logging in to the image forming apparatus 2), thereby requesting update of the data relating to the document.

Then, the document server 3 substitutes the received document file DCF for the existing document file DCF having the same file name that is saved in the directory DY. That is, it deletes the document file DCF that has become one generation old as a result of the current copy processing, and saves the latest generation of the document file DCF that has been received. Similarly, it substitutes the received document information DCJ for the existing document information DCJ having the same document number.

After completion of the processing, the screen display processing portion 2PH in FIG. 3 notifies the document number of the document and the password reissued by the password issuing portion 22*g* to the user by displaying them on the touch panel display 20*j*. The user needs to remember this new password. The user can forget the old password (the currently entered password), since it will no longer be used.

Next, the flow of the processing of the image forming apparatus 2 when copying a document is described with reference to the flowchart shown in FIG. 12 and FIG. 13.

Figure 12:
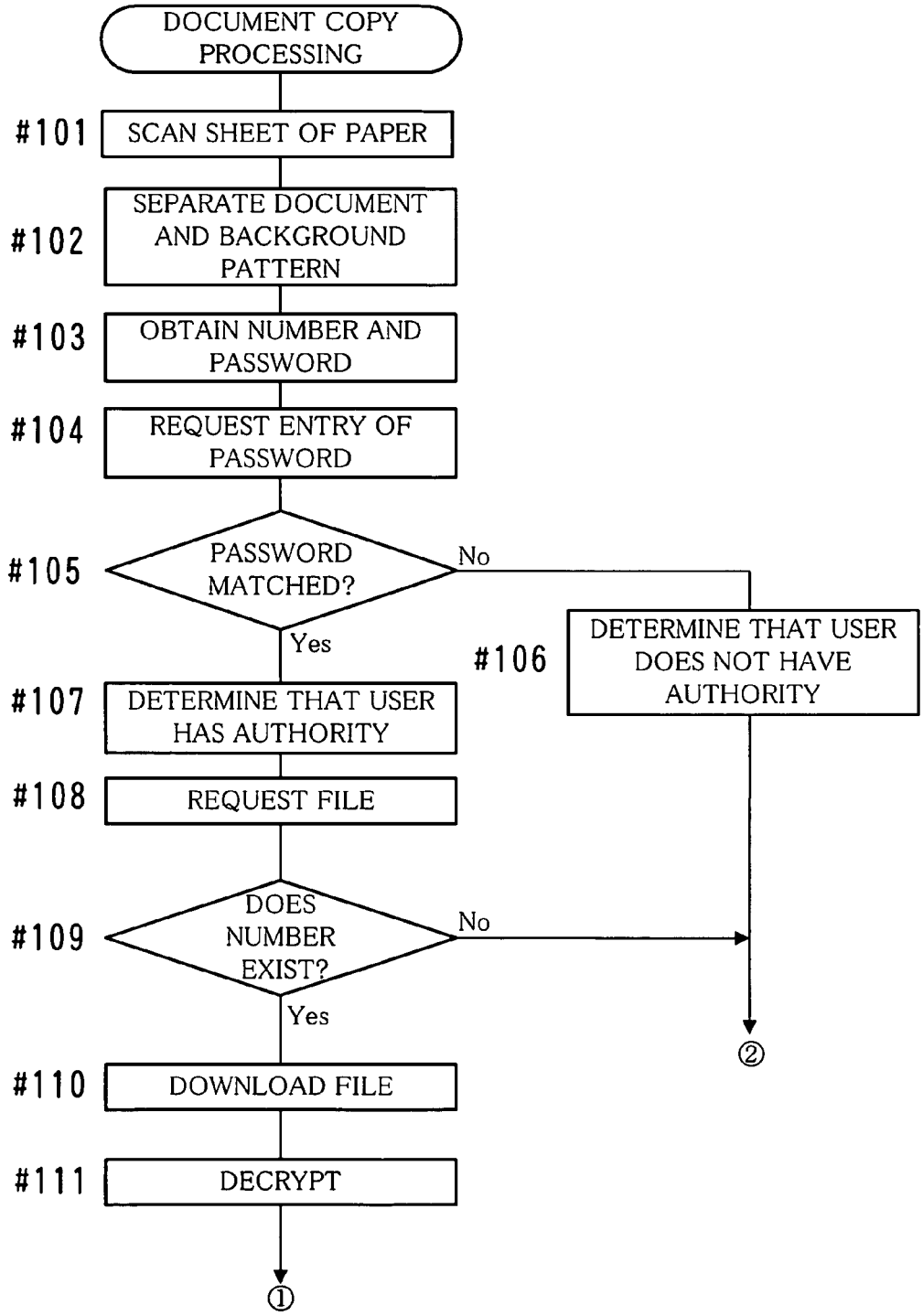
FIG. 12 is a flowchart illustrating an example of the flow of document copy processing.
Figure 13:
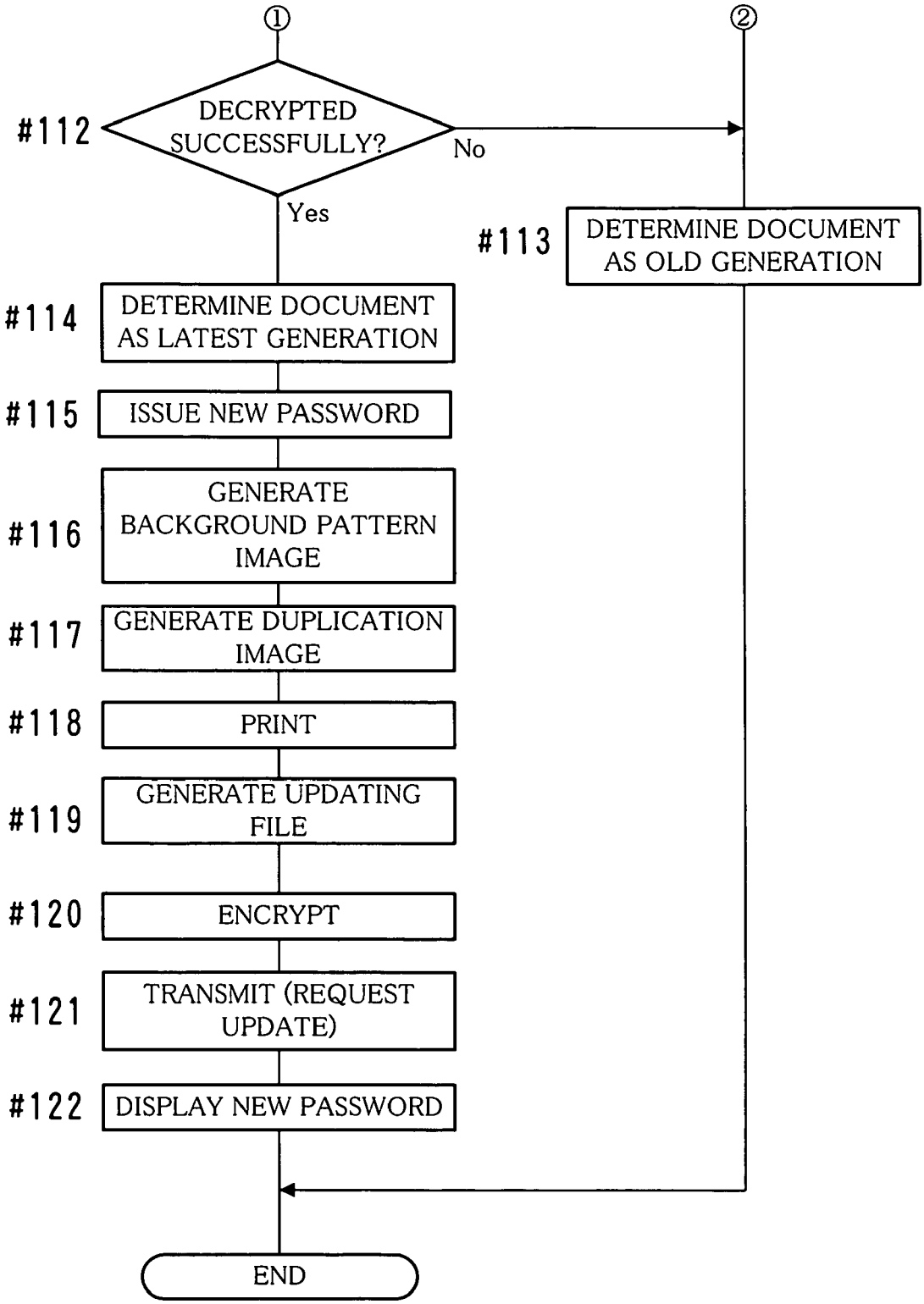
FIG. 13 is a flowchart illustrating an example of the flow of document copy processing.

In FIG. 12, when the user places a sheet of a document that is to be subjected to copying on the platen, and touches the "copy" button on the processing command screen HG2 (see FIG. 6), the image forming apparatus 2 reads the image depicted on the script surface of the sheet, and obtains a read image GA1 (#101). In the following, a case is described where the original document (i.e., a first generation document) is subjected to the document copy processing, as an example.

As shown in FIG. 10, the image forming apparatus 2 separates the read image GA1 into a document image GA2 and a background pattern image GP (#102), and analyzes the background pattern image GP to obtain a document number and a password (#103).

The image forming apparatus 2 then displays a document password entry screen HG3 as shown in FIG. 11 based on the obtained document number to request entry of the password of the document that has been notified when registering the document in the document server 3, and obtains that password (#104).

When the two passwords obtained in Steps #103 and #104 do not match (No in #105), the image forming apparatus 2 determines that the user does not have authority to copy the document (#106), and stops the copy processing for the document. When the two passwords match (Yes in #105), it determines that the user has the authority (#107), and continues the copy processing for the document.

The image forming apparatus 2 requests the document file DCF corresponding to the document number obtained in Step #103 from the document server 3 (#108). When the document file DCF is saved (Yes in #109), it downloads that document file DCF (#110). When the document file DCF is not saved (No in #109), the document copy processing is stopped.

The image forming apparatus 2 decrypts the downloaded document file DCF using the password entered by the user (#111). When it was possible to decrypt the document file DCF normally (Yes in #112 in FIG. 13), it issues a new password with a character string different from that of the existing password (#115). It should be noted that Steps #113 and #114 are not necessary in the case of copying the original document, and therefore their descriptions have been omitted.

The image forming apparatus 2 generates a background pattern image GP in which the document number of the document and the new password are embedded (#116), arranges the background pattern image GP and the document image in predetermined positions, and combines them, thereby generating a duplication image GA3 (#117). It should be noted that the document image GA2 obtained in Step #102 or the image reproduced from the document file DCF downloaded in Step #110 may be used as the document image. Then, the image forming apparatus 2 prints the duplication image GA3 on a blank sheet of paper (#118). Consequently, the user obtains a sheet on which the original document is copied, i.e., a sheet of a second generation document.

In order to prevent the currently copied original document from being copied again, the image forming apparatus 2 performs the following processing. It regenerates the document file DCF by converting the document image GA2 into a file (#119), and encrypts the file using a new password (#120). Alternatively, the image forming apparatus 2 re-encrypts, using a new password, the document file DCF that has been downloaded from the document server 3 and then decrypted (#120), without performing the regeneration in Step #119.

Then, it transmits the encrypted document file DCF and the document information DCJ relating thereto to the document server 3, and requests the document server 3 to substitute them for the existing document file DCF and the document information DCJ of the document that are currently saved in the document server 3 (#121).

Furthermore, the image forming apparatus 2 notifies the document number and the new password to the user by displaying them at an appropriate timing after the processing in Step #115 (#122).

The user can also let the image forming apparatus 2 copy the thus obtained duplicate, i.e., a second generation document. The user can also subject it to the SCAN-TO-PC processing. The user can also assign a sheet of this second generation document to another user. In this case, when the user permits the assignee to subject the second generation document to copying or SCAN-TO-PC, the user notifies the document number and the new password to the assignee in advance.

Next, the flow of the document copy processing for a case where a second generation document is subjected to processing is described with reference to the flowchart shown in FIG. 12 and FIG. 13. It should be noted that a description has been omitted for the same details as those of the above-described case where the original document is subjected to processing.

In FIG. 12, when the user places a sheet of a second generation document on the platen, and touches the "copy" button on the processing command screen HG2 (see FIG. 6), the image forming apparatus 2 obtains a read image GA1 (#101). Then, it separates the read image GA1 into a document image GA2 and a background pattern image GP (#102), and obtains a document number and a password from the background pattern image GP (#103).

The image forming apparatus 2 requests the user to enter the password corresponding to the second generation document (i.e., the password notified when the document of one generation before was copied to generate its second generation document), and obtains that password (#104).

When the two passwords match (Yes in #105), it determines that the user has the authority to copy the second generation document (#107), and continues the copy processing for the document.

The image forming apparatus 2 then downloads the document file DCF corresponding to the document number obtained in Step #103 from the document server 3 (#108 and #110).

It then decrypts the downloaded document file DCF using the password entered by the user (#111).

If the user has entered the password corresponding to the document of a generation older than the second generation document, then the document file DCF cannot be decrypted. The reason is that, as previously described, the document file DCF saved in the document server 3 is re-encrypted using a new password each time the copy processing (or SCAN-TO-PC processing, which will be described later) is performed for the document.

Such a case occurs, for example, when the user attempts to copy a document of a generation that is not the latest generation (here, the document of a generation older than a second generation, i.e., the original document), believing that the document is the latest generation document. Of course, it also occurs when the user attempts to copy a document, knowing that the document is not of the latest generation.

Therefore, when it was impossible to perform decryption (No in #112 in FIG. 13), the image forming apparatus 2 determines that the generation of the document that the user is attempting to let the image forming apparatus 2 copy is not the latest (#113), and stops the copy processing for the document.

When it was possible to perform decryption (Yes in #112), the image forming apparatus 2 determines that the generation of the document is the latest (#114), and issues a new password with a character string different from that of the existing password (#115).

Then, the image forming apparatus 2 generates a background pattern image GP in which the document number and the new password are embedded (#116), arranges the background pattern image GP and the image of the second generation document in predetermined positions, and combines them, thereby generating a duplication image GA3 (#117). Then, it prints the duplication image GA3 on a blank sheet of paper (#118). Consequently, a sheet of a third generation document is obtained.

In order to prevent the currently copied second generation document from being copied again, the image forming apparatus 2 encrypts the document file DCF using the new password, and substitutes this for the old document file DCF of the document (#119 to #121). Furthermore, it notifies the new password to the user at an appropriate timing (#122).

In the case of copying a document of a third generation or older, the copy processing for the document is also performed as describe above.

[SCAN-TO-PC Processing of Document]

Figure 14:
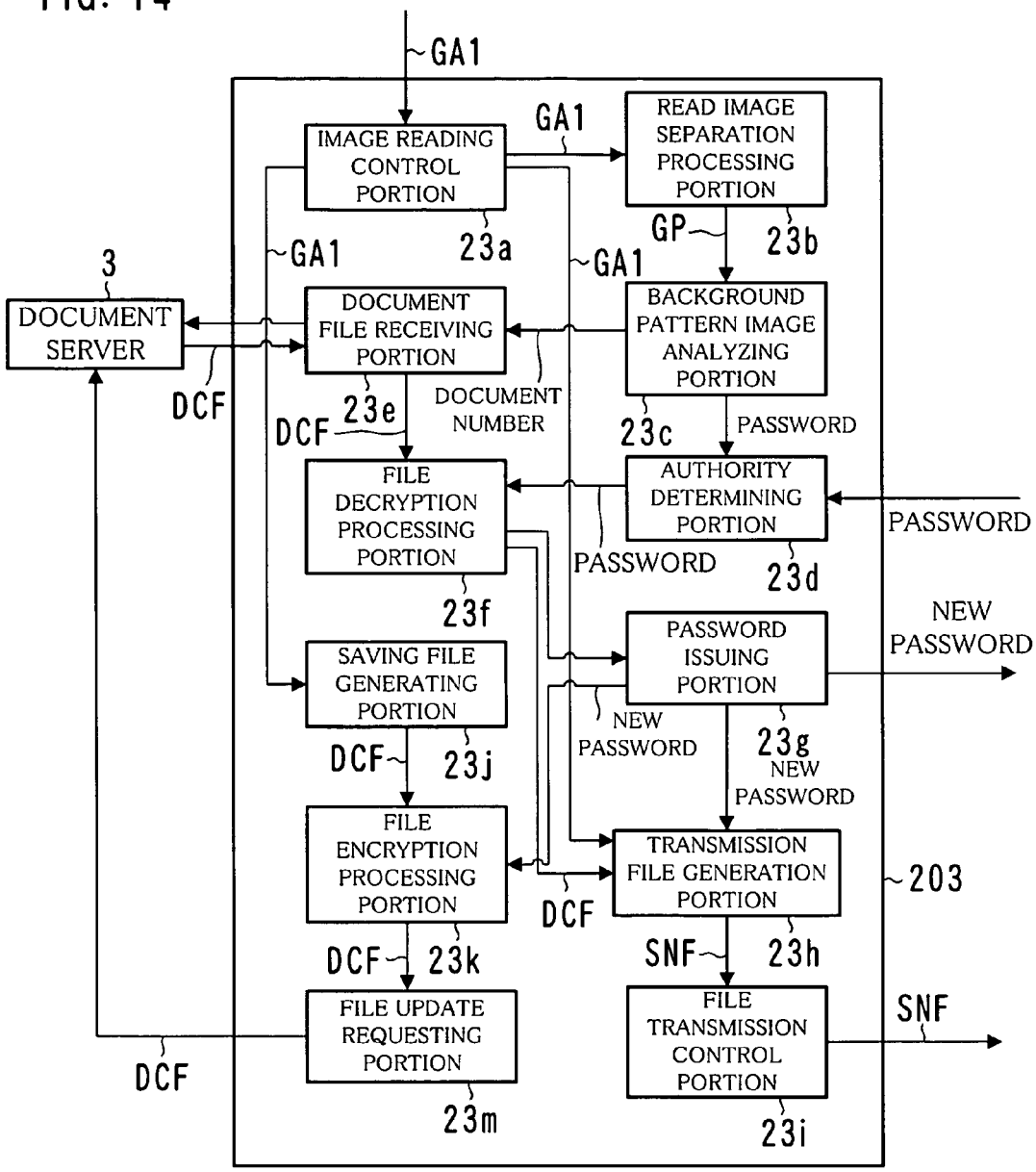
FIG. 14 is a diagram showing an example of the configuration of a document scan and transmission processing portion.

Referring to FIGS. 14 and 15, an example of the configuration of the document scan and transmission processing portion 203 and an example of a document password entry screen HG4 will be described.

As shown in FIG. 14, the document scan and transmission processing portion 203 in FIG. 3 includes, for example, an image reading control portion 23*a*, a read image separation processing portion 23*b*, a background pattern image analyzing portion 23*c*, an authority determining portion 23*d*, a document file receiving portion 23*e*, a file decryption processing portion 23*f*, a password issuing portion 23*g*, a transmission file generation portion 23*h*, a file transmission control portion 23*i*, a saving file generating portion 23*j*, a file encryption processing portion 23*k* and a file update requesting portion 23*m*.

With such a configuration, the document scan and transmission processing portion 203 performs processing for reading a document depicted on a sheet of paper using the SCAN-TO-PC function of the image forming apparatus 2, converting it into electronic data and transmitting the electronic data to a personal computer. At this time, management is carried out such that only a user who has the authority is permitted to perform this processing in accordance with the above-described rule and that the document will not be transmitted more than once per generation.

Among the processing portions in FIG. 14, the image reading control portion 23*a*, the read image separation processing portion 23*b*, the background pattern image analyzing portion 23*c*, the authority determining portion 23*d*, the document file receiving portion 23*e*, the file decryption processing portion 23*f* and the password issuing portion 23*g* similarly function as the image reading control portion 22*a*, the read image separation processing portion 22*b*, the background pattern image analyzing portion 22*c*, the authority determining portion 22*d*, the document file receiving portion 22*e*, the file decryption processing portion 22*f* and the password issuing portion 22*g*, respectively, of the document copy processing portion 202 described with reference to FIG. 9.

That is, the image reading control portion 23*a* controls the scanner unit 20*g* so as to read the image of a document that is to be subjected to the SCAN-TO-PC. Such control is started when the user places a sheet of the document that is to be transmitted to the personal computer on the platen after logging in to the image forming apparatus 2, and touches the "scan" button on the processing command screen HG2 (see FIG. 6). Consequently, the read image GA1 of the document is obtained.

The read image separation processing portion 23*b* separates the read image GA1 into a document image GA2 and a background pattern image GP. The background pattern image analyzing portion 23*c* analyzes the background pattern image GP, thereby extracting the document number and the password expressed by the background pattern image GP.

After the document number is extracted by the background pattern image analyzing portion 23*c*, the screen display processing portion 2PH in FIG. 3 displays on the touch panel display 20*j* the document password entry screen HG4 as shown in FIG. 15 that prompts the user to enter the password corresponding to the document with the document number and the transmission destination of the document data. Here, the user enters the previously notified password of the document, and specifies the transmission destination (e.g., an e-mail address or an IP address) of the document data.

The authority determining portion 23*d* determines whether the user who has provided the command has legitimate authority, based on the entered password and the password embedded in the background pattern image GP. When the authority determining portion 23*d* determines that the user has no legitimate authority, it displays a message indicating that the SCAN-TO-PC processing cannot be performed on the touch panel display 20*j* by the screen display processing portion 2PH, and stops the SCAN-TO-PC processing.

When it is determined that the user has legitimate authority, the document file receiving portion 23*e* receives (downloads), from the document server 3, the document file DCF with the document number obtained by the background pattern image analyzing portion 23*c*.

The file decryption processing portion 23*f* decrypts the received document file DCF using the password entered by the user as a common key (decryption key). As in the case of the copy processing, if the password entered by the user is that of the latest generation of the document, then the document file DCF can be normally decrypted. However, if the password is that of one or more generation older, then the password does not match the encryption key (password) used when encrypting the document file DCF, and therefore decryption cannot be performed. When it was not possible to perform decryption, a message indicating that the SCAN-TO-PC processing cannot be performed is displayed on the touch panel display 20*j*, and the SCAN-TO-PC processing is stopped.

When it was possible to perform decryption, the password issuing portion 23*g* reissues a password with a character string different from that of the password that has been previously issued for the document.

The transmission file generation portion 23*h* generates a document file for transmission to the transmission destination entered by the user as follows. As in the case of the processing in the duplication image generating portion 22*h* in FIG. 9, the transmission file generation portion 23*h* generates a background pattern image GP in which the document number and the new password of the document are embedded. Then, it arranges the document image and the generated background pattern image GP in their respective predetermined positions, and combines them into a single image, thereby generating a duplication image GA3. Then, it converts the image data of the duplication image GA3 into image data in a predetermined format (e.g., PDF by Adobe Systems Incorporated), and converts it into a file. Consequently, the document file is generated. Hereinafter, the generated file is referred to as a "document file SNF".

As in the case of the processing in the duplication image generating portion 22*h*, it is possible to use, as the document image for combination, the document image GA2 obtained by the read image separation processing portion 23*b*, i.e., the image read from the sheet, or the image reproduced from the document file DCF that has been downloaded from the document server 3 and then decrypted.

The file transmission control portion 23*i* controls the communication interface 20*f* so as to transmit the document file SNF generated by the transmission file generation portion 23*h* to the transmission destination specified by the user. For example, when an e-mail address is specified as the transmission destination, the file transmission control portion 23*i* controls the communication interface 20*f* so as to transmit an e-mail to which the document file SNF is attached to the e-mail address. On the other hand, when an IP address is specified as the transmission destination, it controls the communication interface 20*f* to access the personal computer having the IP address and to transmit the document file SNF by a protocol such as FTP (File Transfer Protocol).

After the transmission, the screen display processing portion 2PH in FIG. 3 notifies the document number and the new password of the document to the user by displaying them on the touch panel display 20*j*. The user needs to remember the new password. Alternatively, the user needs to notify the document number and the new password to the owner of a personal computer that is the transmission destination. The user may also transmit an e-mail notifying the document number and the new password of the document to the receiver of the document file SNF.

The personal computer that has received the document file SNF saves the document file SNF in a predetermined storage area. When the user of the personal computer desires to view the document, the user may open the document file SNF using a predetermined application. Then, the document image is displayed on the display of the personal computer. Additionally, the user can also print the document by the printing apparatus connected to the personal computer. Thus, the next generation document is obtained. That is, when the target of the current SCAN-TO-PC is, for example, an m-th generation document, an m+1-th generation document is obtained.

In addition, the document file SNF may also be transmitted to the personal computer after being encrypted using, as the encryption key, the password extracted by the background pattern image analyzing portion 23*c* by analyzing the background pattern image GP. In this case, the transmission destination user needs to enter the password notified by the sender into the personal computer when opening the document file SNF and to decrypt the document file SNF. The document file SNF may also be encrypted using the new password issued by the password issuing portion 23*g*.

The saving file generating portion 23*j*, the file encryption processing portion 23*k* and the file update requesting portion 23*m* perform processes similar to those of the saving file generating portion 22*j*, the file encryption processing portion 22*k* and the file update requesting portion 22*m*, respectively, of the document copy processing portion 202. That is, in order to prevent the document of the generation that has been subjected to the current SCAN-TO-PC from being duplicated again (i.e., in order that only a single copy exists for the latest generation of the document) after completion of the SCAN-TO-PC processing, they perform the following processes.

The saving file generating portion 23*j* regenerates the document file DCF of the document, as needed. The file encryption processing portion 23*k* encrypts the document file DCF that has been regenerated as needed, using the password reissued by the password issuing portion 23*g* as the encryption key.

The file update requesting portion 23*m* transmits, to the document server 3, the encrypted document file DCF together with the document information DCJ indicating, for example, the file name, the document number and the reissued password of the document file DCF, as well as the user name of the user that has performed the current operation (i.e., the user logging in to the image forming apparatus 2), thereby requesting update of the data relating to the document.

Then, the document server 3 substitutes the received document file DCF for the existing document file DCF with the same file name that is saved in the directory DY. Similarly, it substitutes the received document information DCJ for the existing document information DCJ indicating the same document number.

Next, the flow of the SCAN-TO-PC processing is described with reference to the flowchart shown in FIG. 16 and FIG. 17. It should be noted that description has been omitted for of the part in common with the copy processing previously described with reference to FIG. 12 and FIG. 14.

Figure 16:
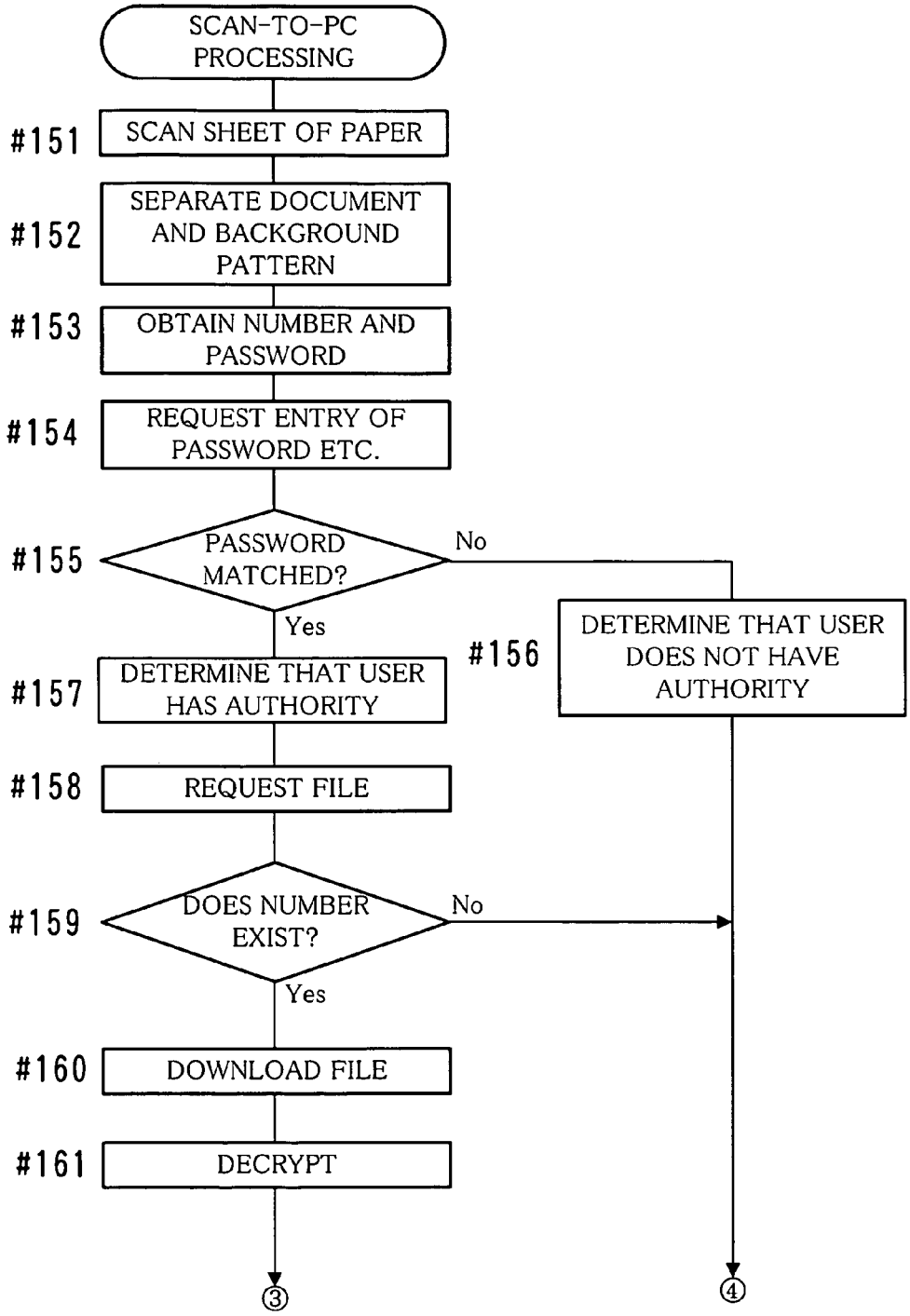
FIG. 16 is a flowchart illustrating an example of the flow of SCAN-TO-PC processing.
Figure 17:
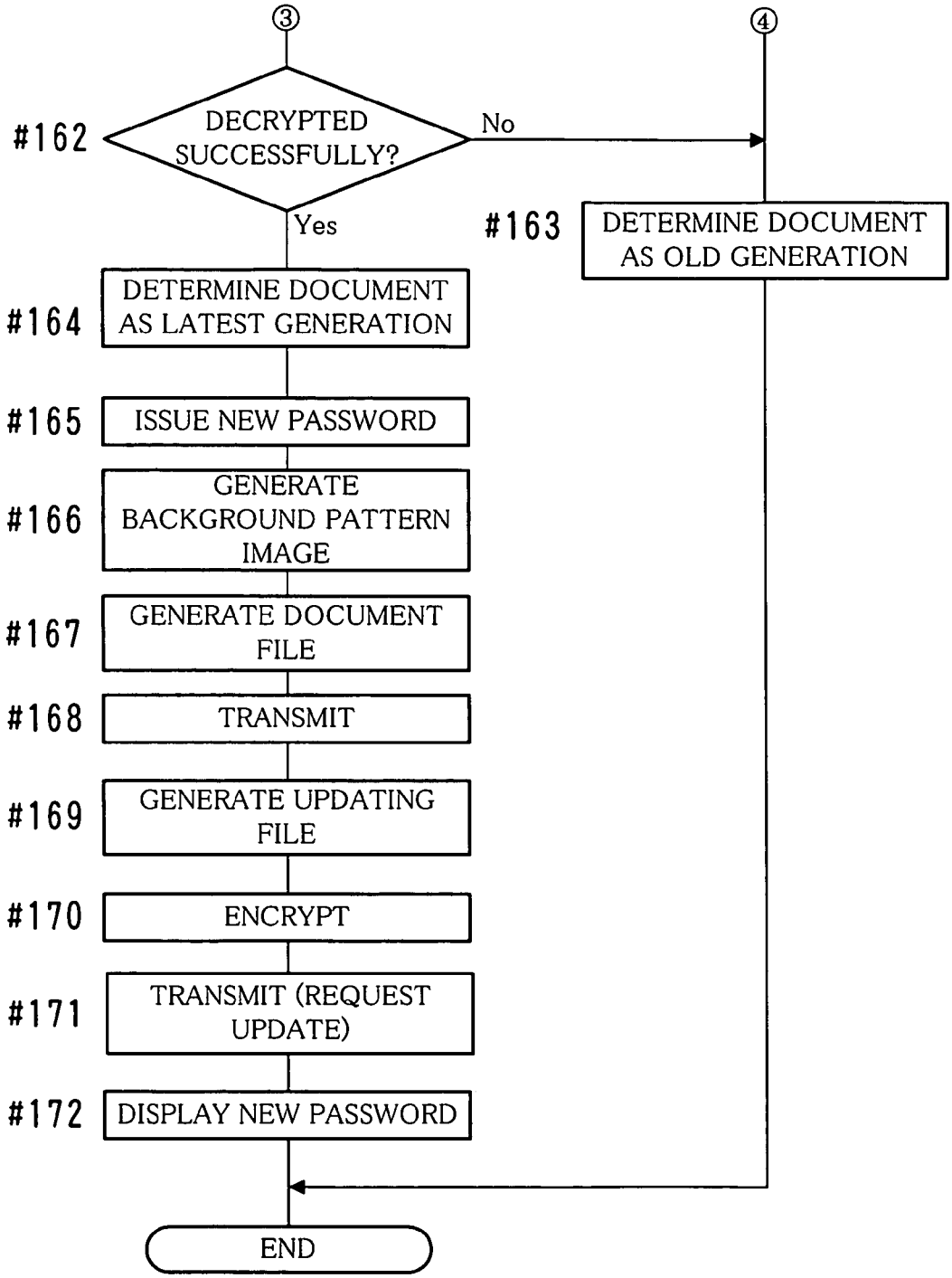
FIG. 17 is a flowchart illustrating an example of the flow of SCAN-TO-PC processing.

In FIG. 16, when the user places a sheet of a document that is to be subjected to SCAN-TO-PC on the platen, and touches the "scan" button on the processing command screen HG2 (see FIG. 6), the image forming apparatus 2 reads the image depicted on the script surface of the sheet, and obtains a read image GA1 (#151). In the following, a case is described where an x-th generation document is subjected to SCAN-TO-PC, as an example.

The image forming apparatus 2 separates the read image GA1 into a document image GA2 and a background pattern image GP (#152), and analyzes the background pattern image GP to obtain a document number and a password (#153).

Based on the obtained document number, it then requests entry of the password and transmission destination of the document by displaying the document password entry screen HG4 as shown in FIG. 15, and obtains them (#154).

When the two passwords obtained in Steps #153 and #154 do not match (No in #155), it determines that the user does not have authority to perform the SCAN-TO-PC of the document (#156), and stops the SCAN-TO-PC processing. When the two passwords match (Yes in #155), it determines that the user has the authority (#157), and continues the SCAN-TO-PC processing.

The image forming apparatus 2 requests the document file DCF corresponding to the document number obtained in Step #153 from the document server 3 (#158). When the document file DCF is saved (Yes in #159), the image forming apparatus 2 downloads that document file DCF (#160). When the document file DCF is not saved (No in #109), it stops the SCAN-TO-PC processing.

Then, the image forming apparatus 2 decrypts the downloaded document file DCF using the password entered by the user (#161).

If the user has entered the password corresponding to a document of the x−1th generation or earlier, then the document file DCF cannot be decrypted. The reason is that, as describe above, the document file DCF saved in the document server 3 is re-encrypted using a new password each time the copy processing or the SCAN-TO-PC processing is performed for the document.

Accordingly, when it was not possible to perform decryption (No in #162 in FIG. 17), the image forming apparatus 2 determines that the generation of the document that is to be subjected to the SCAN-TO-PC processing is not the latest (#163), and stops the SCAN-TO-PC processing.

When it was possible to perform decryption (Yes in #162), the image forming apparatus 2 determines that the generation of the document is the latest (#164), and issues a new password with a character string different from that of the existing password (#165).

Then, the image forming apparatus 2 generates a background pattern image GP in which the document number and the new password of the document are embedded (#166). It then arranges the background pattern image GP and the document image in predetermined positions to generate a duplication image GA3, and converts the image data into a file to generate a document file SNF (#167). Then, it transmits the document file SNF to the transmission destination specified by the user (#168). Consequently, the processing for transmitting the document is completed.

In order to prevent SCAN-TO-PC from being performed for the x-th generation document again, the image forming apparatus 2 performs the following processing. The image forming apparatus 2 converts the document image GA2 into a file to regenerate the document file DCF (#169), and encrypts the regenerated document file DCF using a new password (#170). Alternatively, it re-encrypts the document file DCF that has been downloaded from the document server 3 and then decrypted, using a new password (#170), without performing the regeneration.

Then, the image forming apparatus 2 transmits, to the document server 3, the encrypted document file DCF and the document information DCJ relating thereto, and requests the document server 3 to substitute them for the existing document file DCF and document information DCJ of the document that are currently saved in the document server 3 (#171).

Furthermore, the image forming apparatus 2 notifies the document number and the new password to the user by displaying them at an appropriate timing after the processing in Step #165 (#172).

Figure 18:
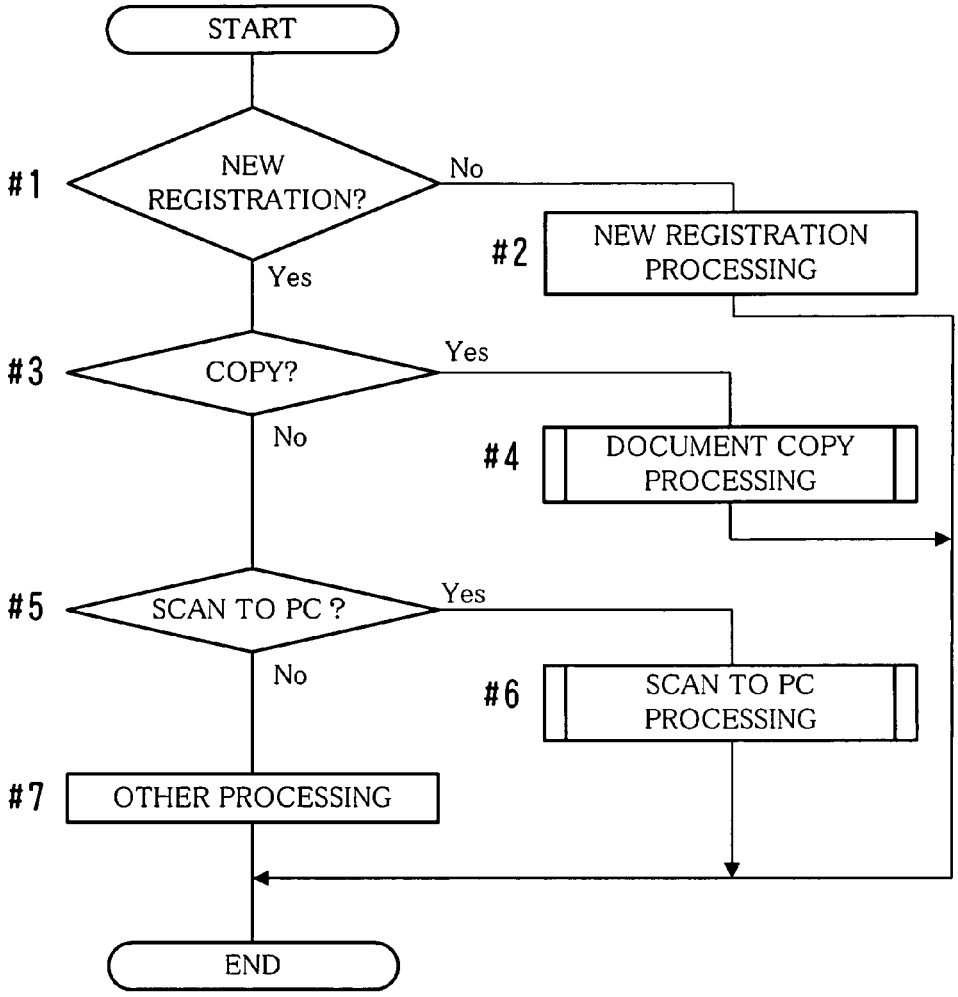
FIG. 18 is a flowchart of overall processing of the image forming apparatus.

Next, the flow of the overall processing of the image forming apparatus 2 is described with reference to the flowchart shown in FIG. 18.

When the user who has logged in to the image forming apparatus 2 touches the "document new registration" button on the processing command screen HG2 shown in FIG. 6 (Yes in #1 in FIG. 18), the image forming apparatus 2 performs processing for registering, in the document server 3, the document data that is to be newly managed (#2). Specifically, the image forming apparatus 2 registers the document file DCF and the document information DCJ of the document in the document server 3. Then, it encrypts the document file DCF by common key cryptography. Further, it notifies the password used as the encryption key at that time to the user.

When the user touches the "copy" button (Yes in #3), the image forming apparatus 2 performs processing for copying the document (#4). The details of such processing are the same as those previously described with reference to FIG. 12 and FIG. 13.

When the user touches the "scan" button (Yes in #5), the image forming apparatus 2 performs the SCAN-TO-PC processing for the document (#6). The details of such processing are the same as those previously described with reference to FIG. 16 and FIG. 17.

When the user performs an operation other than those described above (No in all of #1, #3 and #5), the image forming apparatus 2 performs processing in accordance with the operation in a conventional manner (#7).

According to this embodiment, the requestor is caused to enter a password when performing copying or SCAN-TO-PC for a document. Then, when it was possible to determine that the password is correct and corresponds to the latest generation (version), copying or SCAN-TO-PC is permitted. This makes it possible to easily carry out security management and generation management for a document. Furthermore, the password is reissued after the copying or SCAN-TO-PC processing. Accordingly, it is possible to inhibit copying or SCAN-TO-PC for a document of an earlier generation, thus carrying out even more strict security management.

In this embodiment, cases are described where copying is performed for a document and where SCAN-TO-PC is performed for a document. However, in the case where PC printing (network printing) is performed, the image forming apparatus 2 and the document server 3 function as follows.

Let us assume that, in a personal computer, a document file SNF is opened by a predetermined application (e.g., a PDF file viewer) and a document is displayed. Here, when the user enters a print command, the personal computer transmits the document file SNF to the image forming apparatus 2.

After receiving the document file SNF, the image forming apparatus 2 displays a document password entry screen HG3 as described with reference to FIG. 11 on the touch panel display 20*j*, and waits for the user to enter the password of the document. Here, when the user enters the password, the image forming apparatus 2 decrypts the document file SNF using the password as the decryption key, and expands the document image into a bitmapped image by an RIP based on the document file SNF. In parallel with the processing by the RIP, the image forming apparatus 2 generates a background pattern image GP in which the document number and the password are embedded. Then, it arranges the document image and the background pattern image GP in their respective predetermined positions, and prints the two images on a blank sheet of paper.

Figure 19:
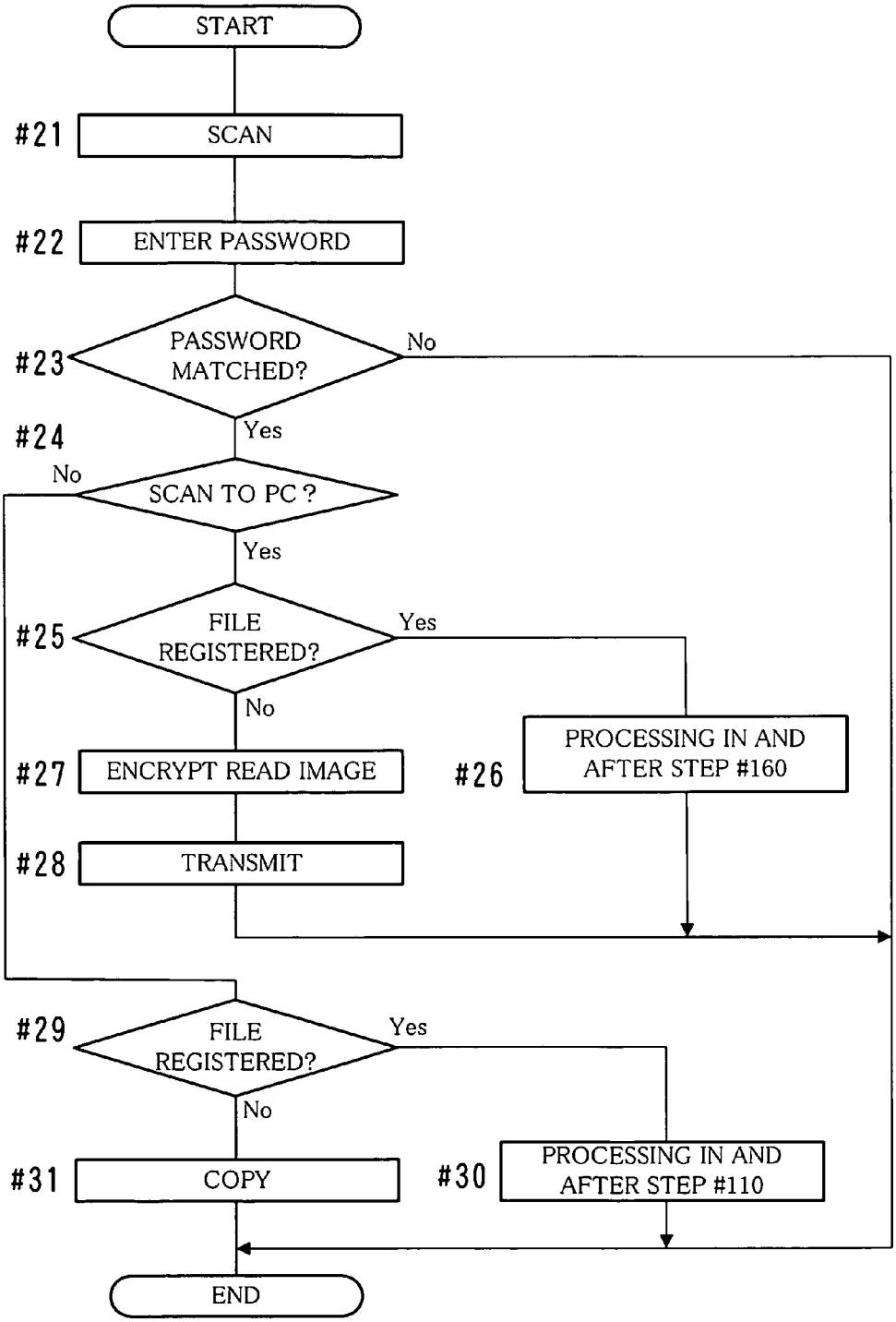
FIG. 19 is a flowchart illustrating a modified example of the overall processing of the image forming apparatus.

Referring to FIG. 19, a flowchart of a modified example of the overall processing of the image forming apparatus 2 is shown.

In the above-described embodiment, the document file DCF and the document information DCJ of a document under security management and generation management need to be registered in the document server 3 in advance. However, when the document file DCF and the document information DCJ are not registered, the image forming apparatus 2 may perform, for example, processing as shown in FIG. 19.

The image forming apparatus 2 scans a sheet of paper on which a document that is to be subjected to processing is depicted, thereby obtaining the image of the document and the background pattern image GP (#21 in FIG. 19). It then lets the user enter the password of the document (#22). When the entered password and the password expressed by the background pattern image GP match (Yes in #23), it determines that the user has the authority to duplicate the document, and continues the processing in and after Step #24. When the two passwords do not match (No in #23), it determines that the user does not have authority to duplicate the document, and stops the processing.

When the current processing is SCAN-TO-PC (Yes in #24 in FIG. 19), the image forming apparatus 2 checks whether the document file DCF corresponding to the document number expressed by the background pattern image GP exists in the document server 3, and when the document file DCF exist (Yes in #25), it performs the processing described with reference to Steps #160 to #172 in FIG. 16 and FIG. 17 (#26).

Conversely, when the document file DCF does not exist (No in #25), the image forming apparatus 2 converts the image data of the document image and the background pattern image GP that have been obtained in Step #21 into a file in a predetermined format (e.g., PDF), and encrypts this file using the password expressed by the background pattern image GP as the encryption key (#27). Then, it transmits the encrypted file to the destination specified by the user (#28). The processing of Steps #27 and #28 are performed instead of the processing described in Steps #160 to #172 shown in FIG. 17. Because it is determined in Step #25 that this document is not a target of generation management although it is managed by the password.

When the current processing is copying (No in #24 in FIG. 19), the image forming apparatus 2 checks whether the document file DCF corresponding to the document number expressed by the background pattern image GP exists in the document server 3, and when the document file DCF exists (Yes in #29), it performs the processing described with reference to Steps #110 to #122 in FIG. 12 and FIG. 13 (#30).

Conversely, when the document file DCF does not exist (No in #29), the image forming apparatus 2 prints an image in which the background pattern image GP is embedded in the document image on a blank sheet of paper (#31). Because, similarly to the case of the SCAN-TO-PC, it is determined in Step #25 that this document is not a target of generation management although it is managed by the password.

In this embodiment, encryption and decryption are performed by common key cryptography. However, it is also possible to use public key cryptography. In this case, a public key may be used as the password embedded in the background pattern image GP, and a private key may be used as the password notified to the user. With public key cryptography, it is possible to prevent unauthorized duplication of a document even if the password embedded in the background pattern image GP has been illegally decrypted.

In this embodiment, a configuration is adopted in which the document password is managed in the document information database DB1 (see FIG. 7) of the document server 3. However, it is also possible to adopt a configuration in which the document password is not managed. In this case, the image forming apparatus 2 does not need to notify the password used for encrypting the document file DCF to the document server 3. By not performing transmission and reception of the password in this way, it is possible to improve the security.

The present invention can also be applied to a case where a plurality of image forming apparatuses 2 is provided in the document management system 1. Furthermore, the present invention can also be applied to a single image forming apparatus 2 provided with the function of managing documents (a so-called "box function").

The number of the generations, for example, "the second generation", "the third generation", "the fourth generation", etc., may be incremented each time copying or SCAN-TO-PC is performed, and the generation number may be embedded in the background pattern image GP together with the document number and the password. Alternatively, the generation number may be included in the document information DCJ.

When it was not possible to obtain the document number in Step #103 in FIG. 12 or Step #153 in FIG. 16, the document that is to be subjected to copying or SCAN-TO-PC may be considered not being under security management and generation management, so that the processing in and after Step #104 or Step #154 may be skipped, and copying or SCAN-TO-PC may be performed for the document in a conventional manner.

In this embodiment, the copy processing is stopped when the password entered by the user and the password expressed by the background pattern image GP do not match or when the document file DCF cannot be decrypted. However, printing may be performed for the document after embedding a background pattern expressing "COPY" on the entire sheet instead of embedding the background pattern image GP. Alternatively, image data of the document image in which a background pattern expressing "COPY" is embedded instead of the background pattern image GP may be transmitted to the personal computer as the document file SNF.

In this embodiment, the background pattern image is used to render the document number and the password difficult to recognize by a human. However, the document number and the password may be embedded in a photograph or a logotype by the known steganography technique, and this may be used in place of the background pattern image GP. There are many documents relating to the "steganography technique". For example, the following publications will help to understand the term.

U.S. patent application publication No. 2002/0051162

U.S. Pat. No. 6,556,688

In addition, the overall configuration of the document management system 1, the image forming apparatus 2 and the document server 3, the configurations of various portions thereof, the details of processing, the processing order, the configuration of the database, and the like may be changed as needed.

While example embodiments of the present invention have been shown and described, it will be understood that the present invention is not limited thereto, and that various changes and modifications may be made by those skilled in the art without departing from the scope of the invention as set forth in the appended claims and their equivalents.

What is claimed is:

1. A document management method comprising:

depicting an image of a document on a sheet of paper together with a key image expressing a first key in a form that is difficult to recognize by a human;

notifying a second key corresponding to the first key to a person having authority to duplicate the document;

letting a requestor requesting duplication of the document enter the second key;

obtaining the document image and the key image by scanning the sheet;

determining whether the requestor has said authority, based on the second key entered by the requestor and the first key expressed by the obtained key image;

changing the content of the first key and the content of the second key when it is determined that the requestor has said authority;

performing duplication processing for duplicating the document image onto a recording medium together with the key image expressing the changed first key; and notifying the changed second key to a person having authority to duplicate the document duplicated onto the recording medium.

2. The document management method according to claim 1, wherein the duplication processing is performed by printing the key image and the document image on a different sheet of paper.

3. The document management method according to claim 1, wherein the duplication processing is performed by transmitting, to a transmission destination specified by the requestor, electronic data for reproducing the key image and the document image.

4. The document management method according to claim 1, wherein duplication of the document is denied when it cannot be determined that the requestor has said authority.

5. A document management method comprising:

depicting an image of a document on a sheet of paper together with a key image expressing a first key in a form that is difficult to recognize by a human;

notifying a second key corresponding to the first key to a person having authority to duplicate the document;

encrypting electronic data for reproducing the document image using a third key corresponding to the second key to save the electronic data;

letting a requestor requesting duplication of the document enter the second key;

obtaining the key image by scanning the sheet;

determining whether the requestor has said authority, based on the second key entered by the requestor and the first key expressed by the obtained key image;

performing processing for decrypting the electronic data using the second key entered by the requestor;

changing the content of the first key, the content of the second key and the content of the third key when it is determined that the requestor has said authority and to decrypt the electronic data;

performing duplication processing for duplicating the document image onto a recording medium together with the key image expressing the changed first key;

re-encrypting the decrypted electronic data using the changed third key; and notifying the changed second key to a person having authority to duplicate the document duplicated onto the recording medium.

6. The document management method according to claim 5, wherein the duplication processing is performed by printing the key image and the document image on a different sheet of paper.

7. The document management method according to claim 5, wherein the duplication processing is performed by transmitting, to a transmission destination specified by the requestor, second electronic data for reproducing the key image and the document image.

8. The document management method according to claim 5, wherein duplication of the document is denied when it cannot be determined that the requestor has said authority or when the electronic data cannot be decrypted.

9. The document management method according to claim 5, wherein all of the first key, the second key and the third key are represented by the same character string, and the electronic data is encrypted by common key cryptography.

10. The document management method according to claim 5, wherein the first key and the second key are a public key and a private key, respectively, of public key cryptography.

11. A document management method comprising:

depicting an image of a document on a sheet of paper together with a key image expressing a first key in a form that is difficult to recognize by a human;

notifying a second key corresponding to the first key to a person having authority to duplicate the document;

letting a requestor requesting duplication of the document enter the second key;

obtaining the document image and the key image by scanning the sheet;

determining whether the requestor has said authority, based on the second key entered by the requestor and the first key expressed by the obtained key image;

encrypting image data of the document image using the second key as an encryption key when it is determined that the requestor has said authority; and transmitting the encrypted image data to a destination specified by the requestor.

12. A document management system comprising:

an image reading portion that reads an image of a document and a key image expressing a first key in a form that is difficult to recognize by a human that are depicted on a sheet of paper, by scanning the sheet;

a key entry portion that lets a user enter a second key corresponding to the first key;

an authority determining portion that determines whether the user has authority to duplicate the document, based on the second key entered by the user and the first key expressed by the read key image;

a key changing portion that changes the content of the first key and the content of the second key when it is determined that the user has said authority;

a document duplication processing portion that performs duplication processing for duplicating the document image onto a recording medium together with the key image expressing the changed first key; and a changed key notifying portion that notifies the changed second key to a person having authority to duplicate the document duplicated onto the recording medium.

13. A document management system comprising:

a key image reading portion that reads a key image expressing a first key in a form that is difficult to recognize by a human that is depicted on a sheet of paper together with an image of a document, by scanning the sheet;

a key entry portion that lets a user enter a second key corresponding to the first key;

an electronic data saving portion that encrypts electronic data for reproducing the document image using a third key corresponding to the second key, and saves the electronic data;

an authority determining portion that determines whether the user has authority to duplicate the document, based on the second key entered by the user and the first key expressed by the read key image;

a decrypting portion that decrypts the electronic data using the second key entered by the user;

a key changing portion that changes the content of the first key, the content of the second key and the content of the third key when it is determined that the user has said authority and to decrypt the electronic data;

a duplication processing portion that performs duplication processing for duplicating the document image onto a recording medium together with the key image expressing the changed first key;

an encryption portion that re-encrypts the decrypted electronic data using the changed third key; and a key notifying portion that notifies the changed second key to a person having authority to duplicate the document duplicated onto the recording medium.

14. A computer program product used for a computer that manages a document, the computer program product letting the computer perform:

processing for reading an image of the document and a key image expressing a first key in a form that is difficult to recognize by a human that are depicted on a sheet of paper;

processing for letting a user enter a second key corresponding to the first key;

processing for determining whether the user has authority to duplicate the document, based on the second key entered by the user and the first key expressed by the read key image;

processing for changing the content of the first key and the content of the second key when it is determined that the user has said authority;

processing for duplicating the document image onto a recording medium together with the key image expressing the changed first key; and processing for notifying the changed second key to a person having authority to duplicate the document duplicated onto the recording medium.

15. A computer program product used for a computer that manages a document, the computer program product letting the computer perform:

processing for reading a key image expressing a first key in a form that is difficult to recognize by a human, the key image being depicted on a sheet of paper together with an image of the document;

processing for letting a user enter a second key corresponding to the first key;

processing for determining whether the user has authority to duplicate the document, based on the second key entered by the user and the first key expressed by the read key image;

processing for decrypting electronic data for reproducing the document image using the second key entered by the user, the electronic data being encrypted using a third key corresponding to the second key and being saved in a saving unit;

processing for changing the content of the first key, the content of the second key and the content of the third key when it is determined that the user has said authority and to decrypt the electronic data;

processing for duplicating the document image onto a recording medium together with the key image expressing the changed first key;

processing for re-encrypting the decrypted electronic data using the changed third key; and processing for notifying the changed second key to a person having authority to duplicate the document duplicated onto the recording medium.

* * * * *